US010996611B2

(12) United States Patent
Zhang et al.

(10) Patent No.: US 10,996,611 B2
(45) Date of Patent: May 4, 2021

(54) CHIP AND REPLACEABLE UNIT OF IMAGE FORMING APPARATUS

(71) Applicant: Zhuhai Pantum Electronics Co., Ltd., Zhuhai (CN)

(72) Inventors: Hao Zhang, Zhuhai (CN); Haixiong Li, Zhuhai (CN); Aiguo Yin, Zhuhai (CN)

(73) Assignee: ZHUHAI PANTUM ELECTRONICS CO., LTD., Zhuhai (CN)

( * ) Notice: Subject to any disclaimer, the term of this patent is extended or adjusted under 35 U.S.C. 154(b) by 0 days.

(21) Appl. No.: 16/846,316

(22) Filed: Apr. 11, 2020

(65) Prior Publication Data

US 2020/0241461 A1 Jul. 30, 2020

Related U.S. Application Data

(63) Continuation of application No. PCT/CN2018/108352, filed on Sep. 28, 2018.

(30) Foreign Application Priority Data

Oct. 11, 2017 (CN) ..... 201721306855.2

(51) Int. Cl.
*G03G 15/00* (2006.01)
*G03G 15/06* (2006.01)

(52) U.S. Cl.
CPC ..... *G03G 15/80* (2013.01); *G03G 15/065* (2013.01)

(58) Field of Classification Search
CPC ..... G03G 15/80; G03G 15/065
See application file for complete search history.

(56) References Cited

U.S. PATENT DOCUMENTS

2013/0279924 A1* 10/2013 Xie ..... G03G 15/80 399/24

FOREIGN PATENT DOCUMENTS

| | | | |
|---|---|---|---|
| CN | 1395526 | A | 2/2003 |
| CN | 104354473 | A | 2/2015 |
| CN | 105912060 | A | 8/2016 |
| CN | 107599656 | A | 1/2018 |
| CN | 207416329 | U | 5/2018 |
| JP | 2016133665 | A | 7/2016 |
| WO | 2010079798 | A1 | 7/2010 |

OTHER PUBLICATIONS

The World Intellectual Property Organization (WIPO) International Search Report and Written Opionion for PCT/CN2018/108352 dated Jan. 7, 2019 13 Pages (including translation).

* cited by examiner

*Primary Examiner* — Sandra Brase
(74) *Attorney, Agent, or Firm* — Anova Law Group, PLLC

(57) ABSTRACT

A chip used for a replaceable unit of an image forming apparatus includes a storage unit configured to store related parameters of the replaceable unit, a plurality of electrical contacts, and an impedance branch. The image forming apparatus is provided with an electrical contact terminal. An electrical contact is capable of electrically connecting to the electrical contact terminal. One end of the impedance branch is connected to at least one of the plurality of electrical contacts for achieving a detection of contact reliability between the at least one of the plurality of electrical contacts connected to the impedance branch and the electrical contact terminal of the image forming apparatus.

18 Claims, 11 Drawing Sheets

CHIP AND REPLACEABLE UNIT OF IMAGE FORMING APPARATUS

CROSS-REFERENCE TO RELATED APPLICATIONS

This application is a continuation application of PCT Patent Application No. PCT/CN2018/108352, filed on Sep. 28, 2018, which claims the priority of Chinese patent applications No. 201710942835.2, filed on Oct. 11, 2017 and No. 201721306855.2, filed on Oct. 11, 2017, the entirety of all of which is incorporated herein by reference.

FIELD OF THE DISCLOSURE

The present disclosure generally relates to the field of image forming technology and, more particularly, relates to a chip for a replaceable unit in an image forming apparatus, an installation detection method of the chip, a replaceable unit for an image forming apparatus, and an image forming apparatus.

BACKGROUND

As imaging technology matures, an image forming apparatus, as a computer peripheral equipment, has gradually gained popularity in offices and homes due to advantages of fast speed and low cost of single-page imaging, etc. According to different functions, the image forming apparatus includes a printer, a copier, a multifunctional integrated machine, etc. According to different imaging principles, the image forming apparatus includes a laser primer, an inkjet printer, a dot-matrix printer, etc.

The image forming apparatus is often provided with a replaceable unit that needs to be replaced. Taking a laser printer as an example, the replaceable unit includes a process cartridge or a developing cartridge for accommodating developer, a fixing unit, a paper accommodating unit, etc. Taking an inkjet printer as an example, the replaceable unit includes an ink cartridge or an ink tank, etc. Taking a dot-matrix printer as an example, the replaceable unit includes an ink ribbon cartridge. When the replaceable unit is not installed in a predetermined position as required, it may cause the replaceable unit not to fit well with any other component in the image forming apparatus. When a replaceable unit with incorrect model is installed to the image forming apparatus, it may also cause the replaceable unit not to fit well with any other component in the image forming apparatus. Even if the installed replaceable unit with incorrect model is capable of being structurally matched with any other component in the image forming apparatus, the replaceable unit with incorrect model may not meet the conditions required by the image forming apparatus for imaging, causing degradation of imaging quality. To prevent the replaceable unit from not being installed in the predetermined position in the image forming apparatus or to prevent the replaceable unit with incorrect model from being installed to the image forming apparatus, in the existing technology, a chip that cooperates with the body of the image forming apparatus to detect the characteristics of the replaceable unit is often provided on the replaceable unit.

For example, a patent with Chinese patent application No. CN01803941.3 discloses an inkjet printer, in which a printer body is provided with an identification device, and an ink cartridge is provided with a chip with a storage unit. The identification device determines whether a wrong ink cartridge is installed in the printer body by comparing whether the identification information stored in the storage unit in the chip is consistent with the predetermined requirements. Another patent with Chinese patent application No. CN201410804409.9 discloses an electrophotographic laser printer, in which a chip substrate in the replaceable unit is provided with a fuse F1 for identifying new and old units and a resistor R1 for indicating a model (sale destination) of the replaceable unit (consumables).

During the process of implementing the present disclosure, the inventors found that by adding a chip in the replaceable unit, after the replaceable unit is installed to the image forming apparatus, whether the chip in the replaceable unit meets the predetermined requirements is detected in the technical solutions in the existing technologies. However, the chip in the existing technologies is lack of technical solutions to cooperate with the detection module/unit in the body of the image forming apparatus to identify whether there is a reliable contact between a contact of the chip and a contact terminal in the body of the image forming apparatus during the installation process of the chip. Specifically, a chip-side contact and the contact terminal in the body are often required to transmit communication information between the chip in the replaceable unit and the detection module unit in the body of the image forming apparatus. The chip-side contact is often in elastic contact with the contact terminal in the body, and, thus, the normal communication process requires a predetermined amount of elastic force between the chip-side contact and the contact terminal in the body to ensure reliable contact between the two parts and to effectively transmit a signal. However, because an elastic element is deformed due to long service time of the image forming apparatus, the elastic element is loose due to transportation, merely a small part of the contact of the chip is in contact with the contact terminal in the body, or the surface of the contact of the chip is dirty (hereinafter also referred to as improper installation), even if the chip-side contact is physically contacted with the contact terminal in the body, the signal cannot be guaranteed to be transmitted as expected. During the communication between the chip and the body of the image forming apparatus, if the contact between the chip-side electrical contact and the electrical contact terminal in the body is unreliable, the following problems may occur.

1. Because the contact between the chip-side electrical contact and the electrical contact terminal in the body is unreliable, it is likely to affect the reliability of the communication between the chip and the body of the image forming apparatus, such that the validity of data transmission cannot be guaranteed.

2. When there is a problem in the validity of data transmission between the chip-side electrical contact and the electrical contact terminal in the body, the existing technologies cannot detect an error caused by the chip itself, or an error caused by improper installation of the replaceable unit, such that the image forming apparatus cannot accurately correspond to the error type.

3. Because the existing technologies cannot distinguish the above error types, a case that there is no problem with the chip itself, but due to the improper installation of the replaceable unit, the existing technologies merely prompt that the replaceable unit does not meet the requirements, may occur. Therefore, the use; is likely to think that the chip of the replaceable unit itself has an error, and cannot be aware of that it is an error caused by improper installation of the replaceable unit in time. The replaceable unit can be used after being installed again according to the correct installation method.

BRIEF SUMMARY OF THE DISCLOSURE

To resolve the technical problems of detecting whether contact between the main body of the image forming apparatus and the chip a reliable that is lack in the existing technologies, the present disclosure provides a chip for a replaceable unit in an image forming apparatus, an installation detection method of the chip, a replaceable unit for an image forming apparatus, and an image forming apparatus. Therefore, whether there is a reliable contact between a conductive contact of the chip and a contact terminal of a body of the image forming apparatus may be accurately detected.

One aspect of the present disclosure provides a chip for a replaceable unit in an image forming apparatus, the chip including:

a storage unit, storing performance parameters of the replaceable unit; and a substrate, provided with a clock signal terminal, a data signal terminal and a connection circuit, that are capable of transmitting an electrical signal, where the connection circuit includes an impedance branch disposed between the clock signal terminal and the data signal terminal.

Optionally, the impedance branch includes a resistance element having a predetermined impedance value, where the resistance element has an end connected to the clock signal terminal, and another end connected to the data signal terminal.

Another aspect of the present disclosure provides a chip for a replaceable unit in an image forming apparatus, the chip including:

a storage unit, storing performance parameters of the replaceable unit; and a substrate, provided with a clock signal terminal, a data signal terminal and a connection circuit, that are capable of transmitting an electrical signal, where the connection circuit includes a first impedance branch having one end connected to the clock signal terminal and another end connected to ground, and a second impedance branch having one end connected to the data signal terminal and another end connected to ground.

In the above technical solutions provided by the present disclosure, the chip is provided with the impedance branch, as a to-be-detected circuit, which is used to cooperatively detect the contact reliability state between the electrical contact of the chip and the electrical contact terminal of the main body of the image forming apparatus. Thus, when the replaceable unit is installed to the image forming apparatus, if the contact reliability between the chip-side electrical contact and the body-side electrical contact terminal of the image forming apparatus does not meet the requirements due to improper installation of the replaceable unit, such state is detected in time.

Another aspect of the present disclosure provides a chip, used for a replaceable unit of an image forming apparatus, where the image forming apparatus is provided with an electrical contact terminal, the chip including:

a storage unit, where the storage unit stores related parameters of the replaceable unit; and a plurality of electrical contacts, where an electrical contact is capable of electrically connecting to the electrical contact terminal, where the chip further includes:

an impedance branch, where one end of the impedance branch is connected to at least one of the plurality of electrical contacts for achieving a detection of contact reliability between the at least one of the plurality of electrical contacts connected to the impedance branch and the electrical contact terminal of the image forming apparatus.

Optionally, another end of the impedance branch is connected to another electrical contact, such that after the chip is installed to the image forming apparatus, a loop for detecting reliability of electrical connection is formed.

Optionally, one end of the impedance branch is connected to a clock signal terminal of the image forming apparatus, and another end of the impedance branch is connected to a data signal terminal of the image forming apparatus.

Optionally, another end of the impedance branch is ground, such that after the chip is installed to the image forming apparatus, a loop for detecting reliability of electrical connection is formed.

Optionally, the loop for detecting the reliability of the electrical connection is a loop formed between the image forming apparatus and the chip after the replaceable unit is installed to the image forming apparatus; by sampling voltage and/or current of the loop, electrical characteristics formed by contact between the at least one of the plurality of electrical contacts in the chip and a corresponding electrical contact terminal of the image forming apparatus in the loop is obtained; and based on the electrical characteristics formed by the contact, the reliability of electrical connection between the at least one of the plurality of electrical contacts in the chip and the corresponding electrical contact terminal of the image forming apparatus is determined.

In the above technical solutions provided by the present disclosure, the electrical characteristic parameter corresponding to the contact reliability between the chip in the replaceable unit and the image forming apparatus is detected through communication with the serial bus (including IIC, USART, etc.). Therefore, the physical characteristics of the connection between the image forming apparatus and the chip in the replaceable unit is accurately obtained, and the reason why the consumable is not recognized, which is caused by contact or by the chip itself, is accurately prompted to the user.

Another aspect of the present disclosure provides an installation detection method of a chip, where the chip includes an impedance branch, and one end of the impedance branch is connected to at least one of electrical contacts, the method including:

obtaining an electrical signal parameter of at least one electrical contact terminal of a main body of an image forming apparatus corresponding to the at least one of electrical contacts connected to the impedance branch of the chip; and based on the electrical signal parameter and an impedance parameter of the impedance branch, determining a stability state of contact between the at least one of electrical contacts of the chip and the at least one electrical contact terminal of the main body of the image forming apparatus.

Optionally, based on the electrical signal parameter and the impedance parameter of the impedance branch, determining the stability state of the contact between the chip and the main body of the image forming apparatus includes:

based on the electrical signal parameter, calculating an impedance value between the at least one of electrical contacts connected to the impedance branch and the at least one electrical contact terminal of the image forming apparatus; and based on the impedance value, determining the stability state of the contact between the chip and the main body of the image forming apparatus.

Optionally, the method further includes after determining the stability of the contact between the chip and the main body of the image forming apparatus meets requirements, determining whether the chip itself is desirably functional, and outputting status information of whether the chip is desirably functional.

In the above technical solutions provided by the present disclosure, the contact stability state between the electrical contact of the chip and the electrical contact terminal of the main body of the image forming apparatus is accurately determined. Thus, the error caused by improper installation of the replaceable unit, or the unreliable contact between the electrical contact of the chip and the electrical contact terminal of the main body of the image forming apparatus is accurately prompted to the user.

Another aspect of the present disclosure provides a replaceable unit for an image forming apparatus, including:

a developing cartridge, where the developing cartridge is provided with a case, a developer accommodation unit for accommodating developer in the case, a developer-feed element that feeds the developer, and a chip located on an outer surface of the case, the chip including:

a storage unit, storing performance parameters of the replaceable unit, and a plurality of electrical contacts, where an electrical contact is capable of electrically connecting to an electrical contact terminal of the image forming apparatus.

where the chip further includes:

an impedance branch, where one end of the impedance branch is connected to at least one of the plurality of electrical contacts for achieving a detection of contact reliability between the at least one of the plurality of electrical contacts connected to the impedance branch and the electrical contact terminal of the image forming apparatus.

Another aspect of the present disclosure provides a replaceable unit for an image forming apparatus, including:

a drum unit, where the drum unit is provided with a developing cartridge accommodation part for accommodating a developing cartridge, a photosensitive drum, a charging roller for charging the photosensitive drum, and a chip located on an outer surface of a case of the drum unit, the chip including.

a storage unit, storing performance parameters of the replaceable unit, and a plurality of electrical contacts, where an electrical contact is capable of electrically connecting to an electrical contact terminal of the image forming apparatus, where the chip further includes:

an impedance branch, where one end of the impedance branch is connected to at least one of the plurality of electrical contacts for achieving a detection of contact reliability between the at least one of the plurality of electrical contacts connected to the impedance branch and the electrical contact terminal of the image forming apparatus.

Another aspect of the present disclosure provides an image forming apparatus, including:

a main body for accommodating a replaceable unit, where the main body is provided with a communication unit connected to one chip, and the communication unit is provided with a plurality of electrical contact terminals; and the replaceable unit, where the replaceable unit is provided with a developing cartridge and/or a drum unit, the developing cartridge is provided with a case, a developer accommodation unit for accommodating developer in the case, a developer-feed element that feeds the developer, and a chip located on an outer surface of the case; the drum unit is provided with a developing cartridge accommodation part for accommodating the developing cartridge, a photosensitive drum, a charging roller for charging the photosensitive drum, and another chip located on an outer surface of a case of the drum unit, each chip including.

a plurality of electrical contacts, where an electrical contact is capable of electrically connecting to an electrical contact terminal of the plurality of electrical contact terminals, where the chip further includes;

an impedance branch, where one end of the impedance branch is connected to at least one of the plurality of electrical contacts for achieving a detection of contact reliability between the at least one of the plurality of electrical contacts connected to the impedance branch and the electrical contact terminal of the image forming apparatus.

where the main body is further provided with a detection unit for detecting an electrical signal parameter of at least one of the plurality of electrical contact terminals of the main body of the image forming apparatus corresponding to the at least one of the plurality of electrical contacts connected to the impedance branch in the chip.

In the above technical solutions provided by the present disclosure, at least one of the following beneficial effects may be obtained.

1. Because the chip of the replaceable unit is provided with the impedance branch, as a to-be-detected circuit, which may be used to cooperatively detect the reliability state of the contact between the electrical contact of the chip and the electrical contact terminal of the body of the image forming apparatus, Thus, when the replaceable unit is installed to the image forming apparatus, if the reliability of contact between the chip-side electrical contact and the body-side electrical contact terminal of the image forming apparatus does not meet the requirements, such state may be detected in time.

2. In the above technical solutions provided by the present disclosure, not only whether the contact between conductive contact of the chip and the contacts in the body of the image forming apparatus is stable may be accurately detect, but also the reliability of the contact may be further determined. Thus, the error caused by the unstable contact between the chip and the body of the image forming apparatus may be timely recognized by the detection unit in the image forming apparatus, and further, user may be notified to reinstall the replaceable unit in the correct way through a reminder, to avoid data transmission error possibly caused during the operation process due to unreliable contact between the chip and the body of the image forming apparatus.

3. If the contact between the contact of the chip and the body-side contact terminal of the image forming apparatus is reliable, during the process of detecting the chip itself, and the detection result of the chip itself may be fed back. If the chip itself is desirably functional and merely the contact between the chip and the body of the image forming apparatus is unstable, user may reinstall the replaceable unit, or may reinstall the replaceable unit after cleaning the surface chip of the replaceable unit, and then may use the replaceable unit.

Other features and advantages of the present disclosure will be explained in the subsequent description, and may partly become obvious from the description, or may be understood through technical solutions for implementing the present disclosure. The aims and other advantages of the present disclosure may be achieved and obtained through the structures and/or processes specifically pointed out in the description, claims, and drawings.

BRIEF DESCRIPTION OF THE DRAWINGS

To more clearly illustrate the technical solutions in the disclosed embodiments of the present disclosure, drawings to be used in the description of the disclosed embodiments will be briefly described below. It is obvious that the drawings in the following description are certain embodiments of the present disclosure, and other drawings may be obtained by a person of ordinary skill in the art in view of the drawings provided without creative efforts.

DETAILED DESCRIPTION

The implementation of the present disclosure will be described in detail below in conjunction with the accompanying drawings and embodiments, so as to fully understand and implement the implementation process of how the present disclosure uses technical means to solve technical problems and achieve technical effects. It should be noted that these specific descriptions are merely for those skilled in the art to substantially easily and clearly understand the present disclosure, rather than a limited interpretation of the present disclosure. As long as there is no conflict, various embodiments of the present disclosure and various features in the various embodiments may be combined with each other. The technical solutions formed by the combination of the various features in these different embodiments may be all within the protection scope of the present disclosure.

Exemplary Embodiment 1

Figure 1:
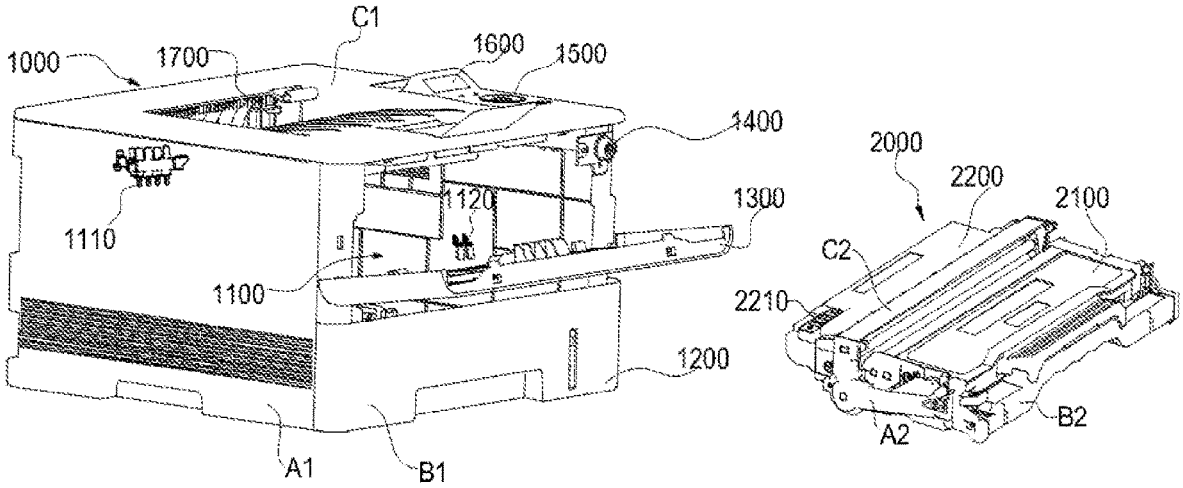
FIG. 1 illustrates schematic diagrams of a frame of an exemplary image forming apparatus and an exemplary process cartridge consistent with an embodiment of the present disclosure.

Referring to FIG. 1, for convenience of description, hereinafter in FIG. 1, a left side surface of an image forming apparatus may be abbreviated as A1, a front surface of the image forming apparatus may be abbreviated as B1, an upper surface of the image forming apparatus may be abbreviated as C1, a right side surface may be opposite to A1, a back surface may be opposite to B1, and a lower surface may be opposite to C1. A left side surface of a process cartridge may be abbreviated as A2, a front surface of the process cartridge may be abbreviated as B2, an upper surface of the process cartridge may be abbreviated as C2, a right side surface may be opposite to A2, a back surface may be opposite to B2, and a lower surface may be opposite to C2. An image forming apparatus 1000 provided by the present embodiment may include: a frame, which is also called a body or main body of the image forming apparatus; a process cartridge mounting part 1100 located in the frame; a paper tray 1200 located under the process cartridge mounting part 1100; a paper-feed unit (not illustrated) disposed between the process cartridge mounting part 1100 and the paper tray 1200; and a door cover 1300 located on the front surface of the frame and connected to the frame through a pivot. When the door cover 1300 is in an open state as illustrated in FIG. 1, a process cartridge 2000 may be mounted to the process cartridge mounting part 1100 or removed from the process cartridge mounting part 1100. When the door cover 1300 rotates toward a back surface with respect to the pivot to a closed state, the process cartridge 2000 may be stably mounted in the process cartridge mounting part 1100. A first communication part 1110 in contact and communicated with a first chip in the process cartridge 2000 and a second communication part 1120 in contact and communicated with a second chip in the process cartridge 2000 may be disposed in the process cartridge mounting part 1100, respectively. The process cartridge 2000 in preferred technical solutions provided by the embodiment may use a split type, in other words, the process cartridge 2000 may include a developing cartridge 2100 for accommodating developer and a drum unit 2200 for mounting a photosensitive drum. The image forming apparatus 1000 provided by the present embodiment may further include a power switch 1400 located on a front surface and near the right side surface and the upper surface of the frame, and an operation panel 1500, a display panel 1600 and a paper discharge part 1700 located on the upper surface of the frame.

One of the inventive concepts of the present embodiment may include detecting reliability state between a chip in a replaceable unit and a communication part on a body-side of the image forming apparatus and communicating with the chip. The replaceable unit mentioned in the present embodiment may be below-mentioned drum unit 2200 in the process cartridge 2000, or may be below-mentioned developing cartridge 2100 in the process cartridge 2000, or may be the process cartridge 2000 including the developing cartridge 2100 and the drum unit 2200. The process cartridge 2000 may be a split process cartridge corresponding to FIG. 1, or may be a one-piece process cartridge. The replaceable unit mentioned in the present embodiment may be any other component, element, and unit that is fragile and needs to be replaced in the image forming apparatus, e.g., the paper tray 1200, or a fixing unit. When a chip that communicates with the body of the image forming apparatus is disposed in the paper tray 1200 or the fixing unit, the technical solution corresponding to the replaceable unit may be protected by the present disclosure.

Figure 2:
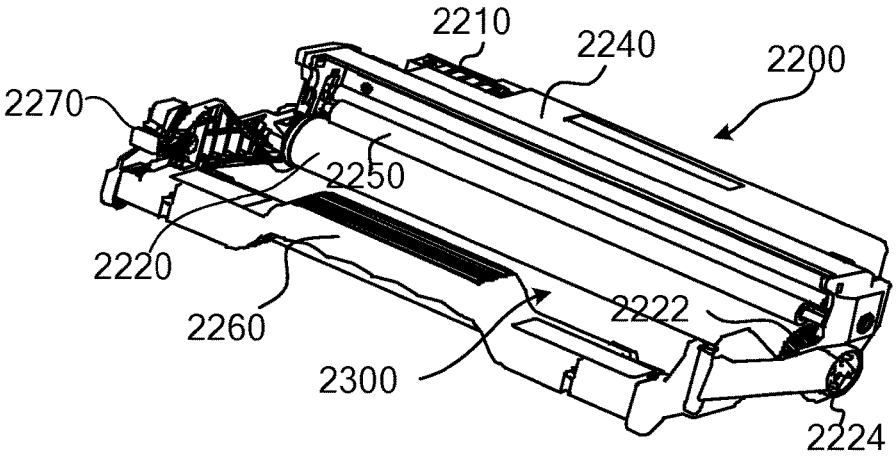
FIG. 2 illustrates a schematic structural diagram of a drum unit in an exemplary process cartridge consistent with an embodiment of the present disclosure.
Figure 3:
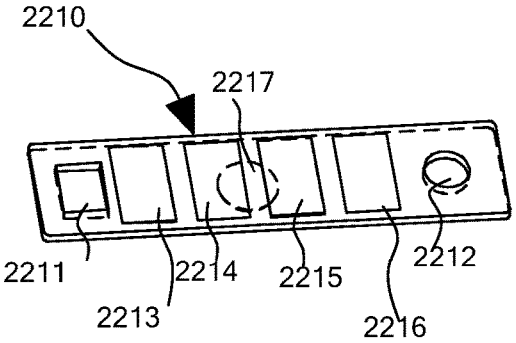
FIG. 3 illustrates a schematic structural diagram of an exemplary chip in a drum unit consistent with an embodiment of the present disclosure.
Figure 4:
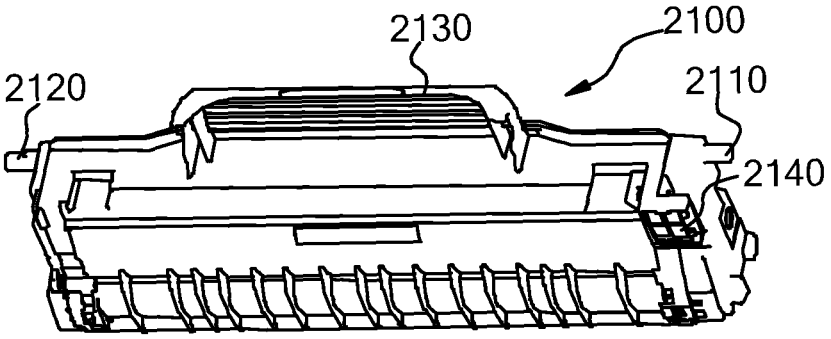
FIG. 4 illustrates a schematic structural diagram of an exemplary developing cartridge consistent with an embodiment of the present disclosure.

Referring to FIG. 2 and FIG. 4, a case (i.e., the portion formed by injection molded parts on the outside) of the drum unit 2290 may be provided with a developing cartridge mounting part 2300 for accommodating the developing cartridge 2100. A locking mechanism 2270 for locking the developing cartridge may be provided at a position on the upper surface and near the left side surface and front surface of the drum unit 2200. Although merely one locking mechanism is illustrated in FIG. 2, those skilled in the art may selectively provide a locking mechanism that is the same as or similar to 2270 at a position on the upper surface and near the right side surface and the front surface of the drum unit 2200. The left side surface and right side surface of the developing cartridge 2100 may be provided with locked portions 2120 and 2110, respectively. A hand-held portion 2260 may be provided at the junction between the front surface and upper surface of the case of the drum unit 2200, to facilitate user to load and unload the process cartridge 2000. The drum unit 2200 may be farther provided with a photosensitive drum 2220 and a charging roller 2250 for charging the photosensitive drum 2220. The right end of the photosensitive drum 2220 may be provided with a driving head 2224 for receiving driving force from the image forming apparatus and a transmission gear 2222 that transmits the power received by the driving head 2224 to a rotating part in the developing cartridge 2100. The drum unit 2200 may also be provided with a waste toner bin 2240 for containing waste toner. A first chip 2210 may be provided at a position on the upper surface and near the back surface and the left side surface of the waste toner bin 2240. Referring to FIG. 2 and FIG. 3, a square hole 2211 and a round hole 2212 may be disposed on a substrate of the first chip 2210, respectively, and a square pillar and a round pillar that match the square hole and the round hole may be disposed on the waste toner bin 2240, respectively. Through the cooperation between the square hole and the square pillar and between the round hole and the round pillar, the chip 2210 may be stably installed on the upper surface of the waste toner bin 2240 without moving back and forth and left and right. In the up-down direction, by thermally welding the round pillar and the square pillar, or by providing a cantilever for defining a position at the end of the square pillar, the first chip 2210 may be ensured not to move in the up-down direction.

Figure 6:
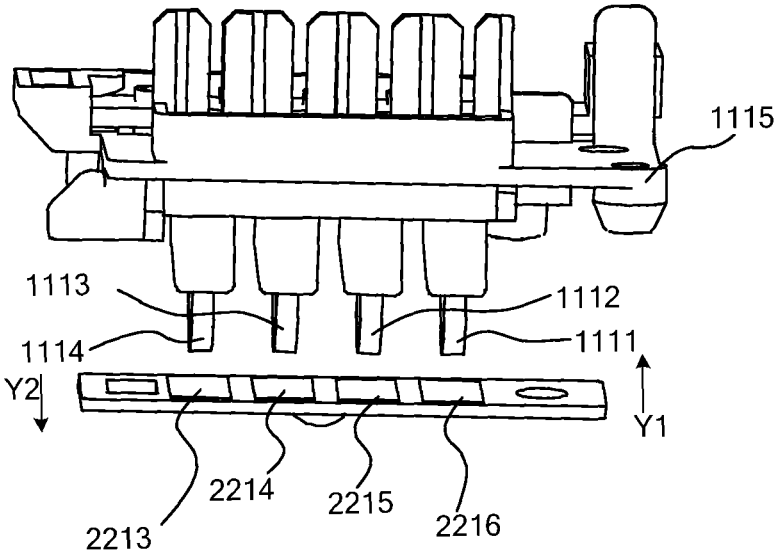
FIG. 6 illustrates schematic structural diagrams of an exemplary chip in a drum unit and terminals in a body of an exemplary image forming apparatus consistent with an embodiment of the present disclosure.

Referring to FIG. 2, FIG. 3 and FIG. 6, four side-by-side conductive terminals (or electrical contacts) may be disposed on the upper surface of the substrate of the first chip 2210. A power supply terminal 2213 may be disposed closest to the left side of the drum unit 2200, a data signal terminal 2214 may be disposed next to the power supply terminal 2213, a ground terminal 2215 may be disposed next to the data signal terminal, and the clock signal terminal 2216 may be disposed on the far right. It should be noted that all conductive terminals in the present embodiment may also be referred to as conductive contacts or contacts. The chip-side conductive terminal may also be referred to as "gold finger". The conductive terminal electrical contact, conductive contact, and contact mentioned in the present embodiment may be a conductive plane, a conductive point, or a conductive line. All the technical solutions provided by the present embodiment may not limit the structural characteristics of the conductive contact. The power supply terminal may be abbreviated as VCC, and the ground terminal may be abbreviated as GND. A microcontroller may be disposed on the lower surface of the first chip 2210. The microcontroller may be integrated into a package element 2217. The package element 2217 may adopt a soft package manner or a hard package manner. In the left-right direction of the drum unit (hereinafter referred to as a length direction of the first chip), the package element 2217 may be located at a middle position between projections of the data signal terminal 2214 and the ground terminal 2215, i.e., the middle position in the length direction of the lower surface of the substrate of the chip. Referring to FIG. 1 and FIG. 6, the first communication part 1110 in the body (frame) of the image forming apparatus may be disposed on a laser scanning unit (LSU, used for exposing the photosensitive drum, not illustrated in the Figure) in the image forming apparatus. The first communication part 1110 may also be provided with a body-side first power supply terminal 1114, a body-side first data signal terminal 1113, a body-side first ground terminal 1112, and a body-side first clock signal terminal 1111 that respectively communicate with the power supply terminal 2213, the data signal terminal 2214, the ground terminal 2215, and the clock signal terminal 2216 in the first chip. Such terminals (or electrical contact terminals) may be fixed to an injection molded part 1115 in the LSU, and may be connected to the main controller in the image forming apparatus through conductive wires.

Figure 5:
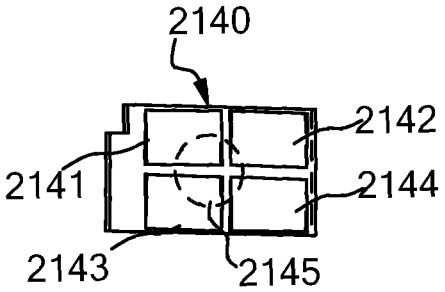
FIG. 5 illustrates a schematic structural diagram of an exemplary chip in a developing cartridge consistent with an embodiment of the present disclosure.

Referring to FIG. 4 and FIG. 5, a hand-held portion 2130 may be disposed on the front surface of the developing cartridge 2109, which may facilitate user to easily load and unload the developing cartridge 2100. In addition, a second chip 2140 may be disposed at a position on the lower surface and near the front surface and the right side surface of the developing cartridge 2100. Similarly, four contacts may be disposed on a surface of a substrate of the second chip 2140. A data signal terminal 2141 and a clock signal terminal 2142 may be disposed in a row near the front surface; and a power supply terminal 2143 and a ground terminal 2144 may be disposed in a second row. A packaging element 2145 may be disposed on another surface of the substrate of the second chip 2140 that is opposite to the surface where the contacts are located. The packaging element 2145 may be located at the center of the substrate of the second chip, as illustrated in FIG. 5. The projection of the packaging element 2145 in a direction perpendicular to the surface where the contacts are located may overlap with the four contacts 2141, 2142, 2143, 2144, respectively.

The "first" and "second" in the present embodiment are merely for the convenience of those skilled in the art to more clearly understand the technical solutions in the present embodiment, and are not limited. Those skilled in the art may swap all the "first" and "second" involved in the first chip and the second chip, the first communication part and the second communication part, or may be limited with more numbers, such as "third", "fourth", etc. In addition, those skilled in the art may set merely the first chip or may set merely the second chip in the process cartridge according to actual product requirements.

Figure 7:
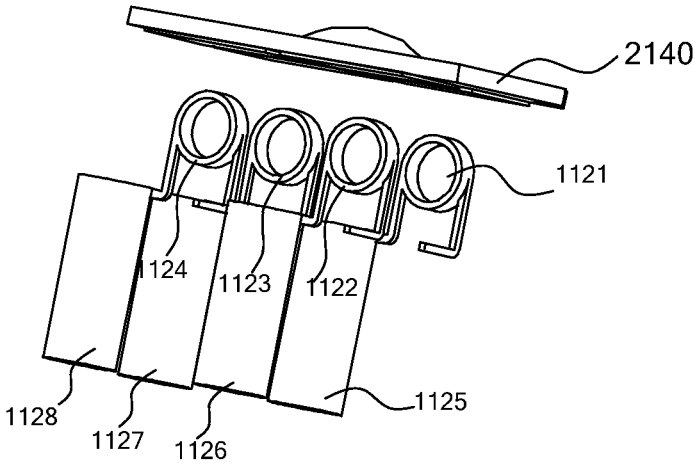
FIG. 7 illustrates schematic structural diagrams of an exemplary chip in a developing cartridge and terminals in a body of an exemplary image forming apparatus consistent with an embodiment of the present disclosure.

Referring to FIG. 1 and FIG. 7, a second communication part 1120 in the body (frame) of the image forming apparatus may be located on the paper-feed unit of the image forming apparatus. The second communication part 1120 may be provided with a body-side second power supply terminal 1123, a body-side second data signal terminal 1121, a body-side second ground terminal 1124, and a body-side second clock signal terminal 1122 that respectively communicate with the power supply terminal 2143, the data signal terminal 2141, the ground terminal 2144, and the clock signal terminal 2142 in the second chip 2140. Such body-side signal terminals may be a part of annular springs, and such annular springs may be respectively connected to the round pillars 1127, 1125, 1128, and 1126. The round pillars 1127, 1125, 1128, and 1126 may also be formed by conductive springs. The conductive springs may be connected to the main controller inside the image forming apparatus through conductive wires, thereby achieving the communication between the conductive terminals in the second communication part 1120 and the conductive terminals in the second chip 2140.

Referring to FIG. 1, FIG. 6, and FIG. 7, during a process of connecting the contacts in the first communication part 1110 and the contacts in the first chip 2210 and connecting the contacts in the second communication part 1120 and the contacts in the second chip 2140, because the process cartridge 2000 is likely not to be installed in the designated position in the process cartridge mounting part 1100, the contact between each chip and corresponding communication part may cause the contact between the body-side contact and the process cartridge-side contact to be in a different state due to the position where the process cartridge is installed. For example, the first chip 2210 in FIG. 6 may be tilted along a Y1-Y2 direction in the Figure, which may cause contact between the body-side contact 1111 and the chip-side contact 2216 to be substantially stable, and the signal transmission may be substantially stable. While the contact between the body-side contact 1114 and the chip-side contact 2213 may be substantially unreliable, which may cause the signal transmission to be unreliable, and may cause the main controller in the body of the image forming apparatus not to receive the signal from the process cartridge-side chip. On another hand, in the preferred technical solution in the present embodiment, the various process cartridge-side contacts may have a square contact surface, while the body-side contact of the image forming apparatus may be arc-shaped spring. Therefore, when the process cartridge 2000 is likely not to be installed in the designated position in the process cartridge mounting part 1100, it may also cause the contact between different body-side contact and corresponding process cartridge-side contact to have different area, and may also cause different impedance values between different body-side contact and corresponding process cartridge-side contact. On another hand, due to the surface processing technology of the chip-side contacts and the body-side contacts of the image forming apparatus (e.g., parts of contact probe/spring), dirty adhered to the surface during use, and surface oxidation, etc., the body-side terminal may tend to be in poor contact with the chip-side contact, and, thus, the main controller of the image forming apparatus cannot correctly recognize the chip. Similarly, the contact process between the body-side contact 1113 and the chip-side contact 2214, and between the body-side contact 1112 and the chip-side contact 2215 may also have the above problems. The contact between the second communication pan 1120 and the second chip 2140 may also have the above problems.

Based on the above reasons, in the technical solutions in the existing technologies, if the above case occurs, it is likely to directly determine that the chip in the process cartridge is abnormal, and to prompt the user to replace the process cartridge. However, the real reason may be that the chip in the process cartridge itself works, and the contact between the body-side contact and the chip-side contact is unreliable. The technical solutions provided by the disclosed embodiment of the present disclosure may accurately detect and distinguish whether the contact between the body-side contact and the chip-side contact is unreliable, or the chip itself is damaged/the chip has reached the service life. The specific detection process may be explained in detail below.

Figure 8:
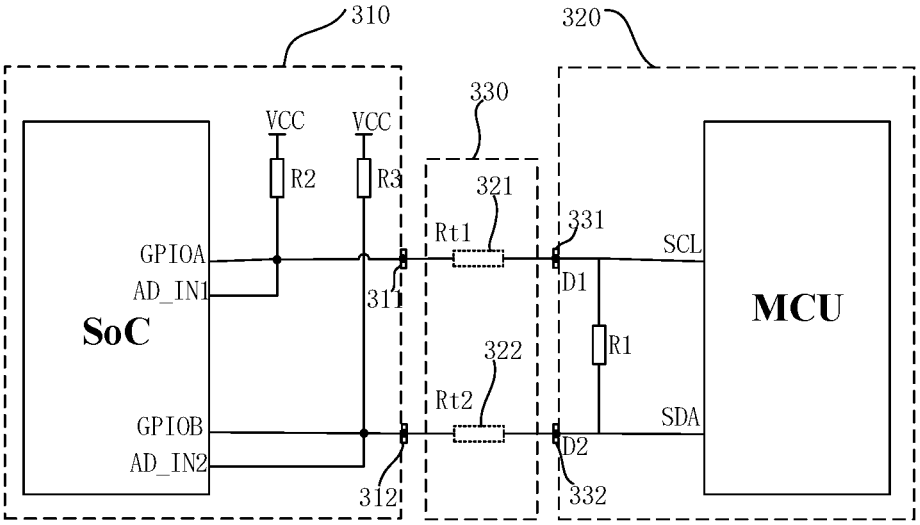
FIG. 8 illustrates a schematic diagram of an exemplary connection circuit between a chip and a body of an image forming apparatus consistent with an embodiment of the present disclosure.

Referring to FIG. 8, a first control circuit 310 may be disposed on the image forming apparatus side, and a second control circuit 320 may be disposed in the chip on the process cartridge side. Contacts on the surface of the first control circuit 310 and the contacts on the surface of the chip substrate may form a contact circuit 330. The contact circuit 330 may include a plurality of contact resistance (reference numeral Rt1) 321 and contact resistance (reference numeral Rt2) 322 connected in parallel. For the convenience of expression and calculation, the resistance value of Rt1 and the resistance value of Rt2 subsequently described in the present embodiment may actually also include the resistance value of the contact itself on the surface of the first control circuit 310 and the resistance value of the contact itself on the surface of the chip substrate, while the resistance value of the contact itself may be substantially small. Therefore, in the present embodiment, the contact resistor Rt1 may be directly called the sum of the resistance between the image forming apparatus-side data signal contact 311 and the chip-side data signal contact 331, the resistance of the data signal contact 311 itself, and the resistance of the data signal contact 331 itself. The contact resistance Rt2 may be the sum of the resistance between the image forming apparatus-side data signal contact 312 and the chip-side data signal contact 332, the resistance of the data signal contact 312 itself, and the resistance of the data signal contact 332 itself. It should be noted that FIG. 8 is merely a simplified schematic diagram, and the quantity of contact resistance in the contact circuit may be determined according to a quantity corresponding to the chip-side contacts and the body-side contacts of the image forming apparatus.

Specifically, the first control circuit 310 in the image forming apparatus 1000 may include a system on chip (SoC, an on-chip operating system, i.e., a main controller in the image forming apparatus 1000). The second control circuit 320 in the process cartridge-side chip may include a microcontroller unit (MCU, a control unit, i.e., the microcontroller in the chip of the process cartridge). SoC and MCU may communicate using 12C bus. The chip corresponding to the dashed frame on the right in FIG. 8 may be the above mentioned first chip 2210 and/or second chip 2140. The MCU of the second control circuit 320 may be provided with a storage unit that stores performance related parameters (e.g., service life information, number of uses, production date, remaining amount of consumables in the replaceable unit, etc.) of the replaceable unit, and a communication unit that communicates with the image forming apparatus. The communication unit may achieve data exchange with the image forming apparatus through SCL and SDA connection lines. To simplify the description of the technical solutions, merely the SCL (data signal line of the I2C bus) and SDA (clock signal line of the J2C bus) are simply illustrated in FIG. 8. For convenience of expression, the data signal terminal in contact with the body of the image forming apparatus in the SCL in FIG. 8 may be abbreviated as D1, and the clock signal terminal in contact with the body of the image forming apparatus in the SDA in FIG. 8 may be abbreviated as D2.

The chip provided in the present embodiment may have an impedance characteristic to-be-detected unit added between D1 and D2. When the process cartridge is installed to the image forming apparatus, the terminals D1 and D2 on the chip and corresponding clock signal terminal and data signal terminal in the image forming apparatus may respectively form the contact resistance Rt1 and Rt2 in FIG. 8. For convenience of expression and calculation, when subsequently describing the resistance value of Rt1 and the resistance value of Rt2 in the present embodiment, the resistance values of Rt1 and Rt2 may actually include the resistance value of the contact itself on the surface of the first control circuit, and the resistance value of the contact itself on the surface of the chip substrate, while the resistance value of the contact itself may be substantially small. As mentioned above, the resistance values of the contact resistance Rt1 and Rt2 may vary with the reliability state of the contact between the body-side contact and the chip-side contact, and the value of the resistance may also be different. In the present embodiment, the specified impedance characteristic to-be-detected unit disposed in the chip may cooperate with the detection unit in the image forming apparatus to accurately detect the resistance values of the contact resistance Rt1 and Rt2, and then according to the resistance values of the contact resistance Rt1 and Rt2, may determine the reliability state of the contact between the body-side contact and the chip-side contact. The detection result may be independent of the judgment of SoC on the goodness of the MCU itself. Therefore, after the process cartridge chip is installed, when a bad situation occurs, the technical solutions provided by the present embodiment may identify whether the bad situation is caused by the chip itself, or by the unreliable slate of the contact between the chip-side contact and body-side contact of the image forming apparatus. Further, if it is the latter, the main controller of the image forming apparatus may send a prompt message to the display panel to prompt the user to pull out the process cartridge, and to reinstall the process cartridge according to the correct method. Further, the main controller of the image forming apparatus may prompt the user through the display panel to try to clean the contacts on the surface of the chip and the contact parts (e.g., contact probes or springs) in the image forming apparatus for troubleshooting.

Specifically, the impedance characteristic to-be-detected unit provided in the present embodiment may include an impedance branch disposed between the SCL line and the SDA line. One end of the impedance branch may be disposed on the SCL line, between D1 and the SCL port in the MCU. Another end may be disposed on the SDA line, between D2 and the SDA port in the MCU. Preferably, the impedance branch may be a resistor R1. Those skilled in the art may also split the resistor R1 into a plurality of different resistors connected in series, or may use other circuit components that are capable of producing similar impedance parameter (hereinafter, for circuits with only resistance calculation, also called resistance parameter). It should be noted that, as a preferred solution in the present embodiment, an impedance element may be provided between the SCL line and the SDA line. Alternatively, two other terminals in the chip, e.g., power supply terminal, ground terminal, SCL port, and SDA port, may be arbitrarily selected as the impedance branch. In addition, in the present embodiment, preferably, the impedance branch may be disposed between the SCL line and the SDA line, which may further facilitate reducing interference to other signals in the transmission of data signal and clock signal.

In the above technical solutions provided by the present embodiment, the impedance branch may be disposed in the chip as a to-be-detected circuit, and may be used to cooperatively detect the reliability state of the contact between the electrical contact of the chip and the electrical contact terminal of the body of the image forming apparatus. Thus, when the replaceable unit is installed to the image forming apparatus, if the reliability of contact between the chip-side electrical contact and the body-side electrical contact terminal of the image forming apparatus does not meet the requirements due to improper installation of the replaceable unit, such state may be detected in time.

The image forming apparatus provided by the present embodiment may be provided with a detection unit. The detection unit may include a first power supply branch and a second power supply branch that are connected to the impedance branch. The first power supply branch may include a VCC and a resistor R2 branch in FIG. 8. The second power supply branch may include a VCC and a resistor R3 branch in FIG. 8. The detection unit may also include logic signal control ports GPIOA and GFIOB in the SoC, and AD_IN1 and AD_IN2 terminals used for detecting current and voltage parameters. The logic signal control ports GPIOA and GPIOB may be divided into high-impedance state and low-impedance state. In the high-impedance state, there may be input and output states. When the state is high-impedance input, the resistance value of the logic signal control port may be infinite. In the low-impedance state, there may be input and output states. When the low-impedance state outputs a high level "1", the output power supply of the corresponding logic signal control port may be VCC. When the low-impedance stale outputs a low level "0", the voltage of the corresponding logic signal control port may be the ground voltage.

The present disclosure also provides an installation detection method of a chip. The method may include: obtaining electrical signal parameter of at least one contact terminal of the body of the image forming apparatus corresponding to an electrical contact connected to an impedance branch in the chip; and based on the electrical signal parameter and the impedance parameter of the impedance branch, determining a stability state of contact between the electrical contact of the chip and the electrical contact terminal of the body of the image forming apparatus. More specifically, the method may include following.

S1: Obtaining a first voltage and/or current parameter of the clock signal terminal in the body of the image forming apparatus.

S2: Obtaining a second voltage and/or current parameter of the data signal terminal in the body of the image forming apparatus.

S3: Based on the impedance parameter of the impedance branch and the power supply voltage of the to-be-detected unit disposed between the second clock signal terminal and the second data signal terminal in the chip, the first voltage and/or current parameter, and the second voltage and/or current parameter, outputting a first impedance parameter between the first clock signal terminal and the second clock signal terminal and a second impedance parameter between the first data signal terminal and the second data signal terminal.

S4: Based on values of the first impedance parameter and the second impedance parameter, outputting the reliability state information of the contact between the second clock signal terminal and the second data signal terminal in the chip and the first clock signal terminal and the first data signal terminal in the body of the image forming apparatus, respectively.

It should be noted that there is no sequence between the above steps S1 and S2, and S1 and S2 may be set to be executed in order or to be executed simultaneously.

Preferably, the above method may further include: after determining that the reliability of the contact between the chip and the body of the image forming apparatus meets the requirements, determining whether the chip itself is desirably functional, and outputting the state information of whether the chip is fin. For specific determination on whether the chip itself is desirably functional, reference may be made to the existing technologies, e.g., determining whether predetermined parameters are stored inside the chip and/or determining whether there is a corresponding component that meets a predetermined model in the chip.

Figure 11:
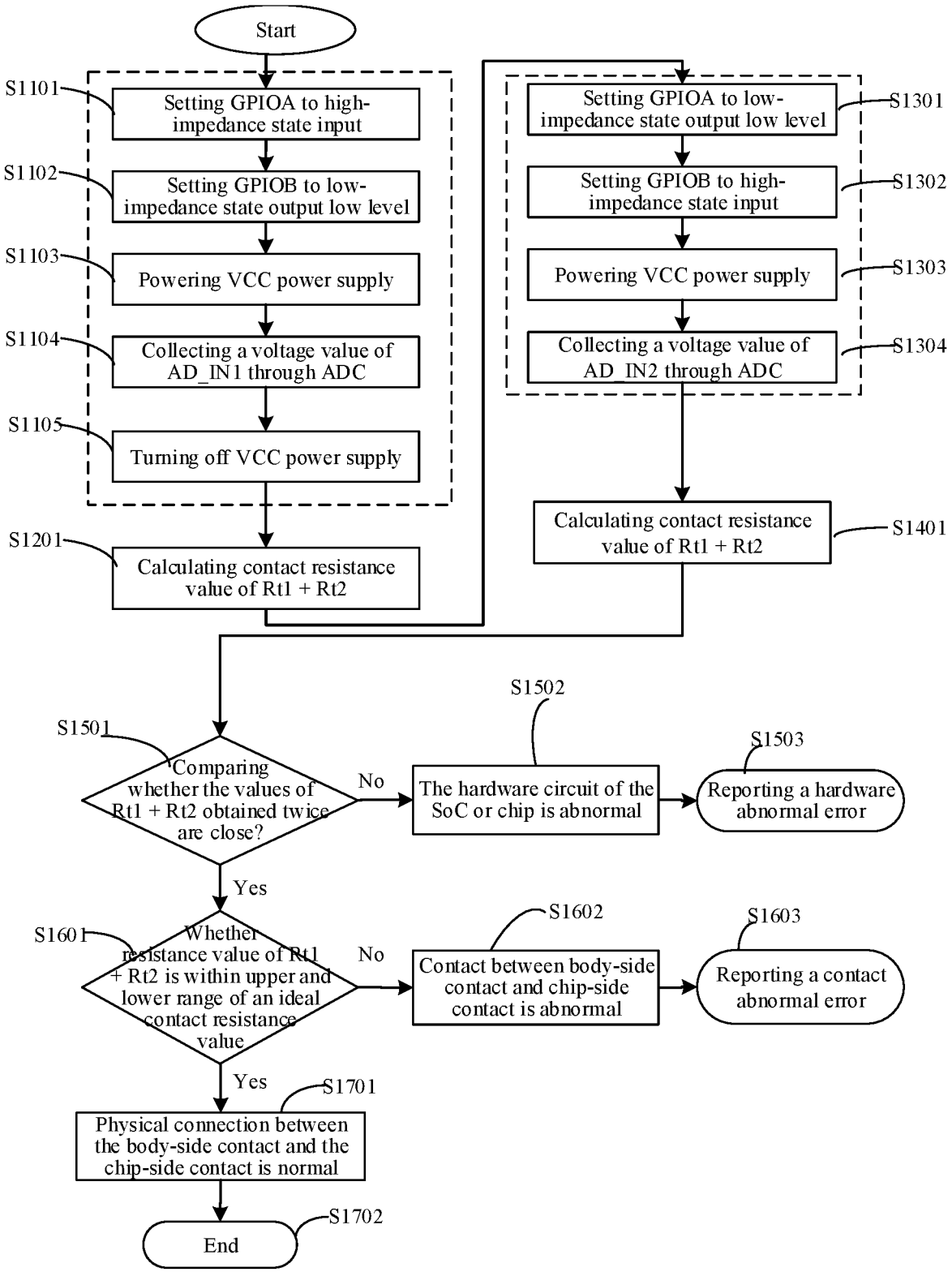
FIG. 11 illustrates a flow chart of an exemplary installation detection method of a chip consistent with an embodiment of the present disclosure.

Specifically, referring to FIG. 8 and FIG. 11, the detection method may include following.

The first round of hardware inspection for detecting the clock signal terminal in the above step S1 may include following.

S1101: GPIOA may be set to high-impedance state input.

S1102: GPIOB may be set to low-impedance state output low level.

S1103: The VCC power supply may be powered, and the amplitude of the voltage may be recorded as Vcc.

S1104: A voltage value of AD_IN1 may be collected through the ADC in the main controller of the image forming apparatus, and the amplitude of the voltage may be recorded as $V_{AD_IN1}$.

S1105: The VCC power supply may be turned off.

Figure 9:
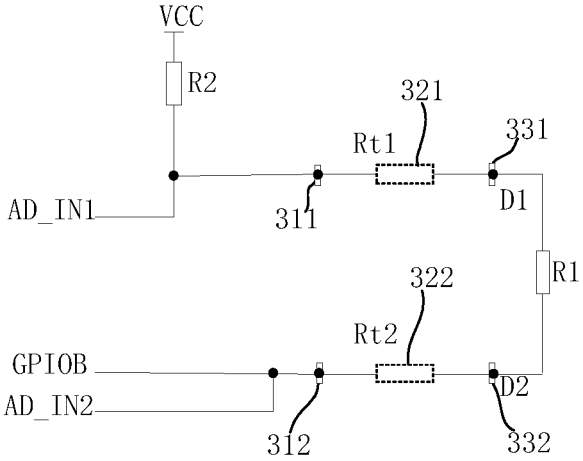
FIG. 9 illustrates a simplified diagram of an exemplary connection circuit between a chip and a body of an image forming apparatus in a first state consistent with an embodiment of the present disclosure.
Figure 10:
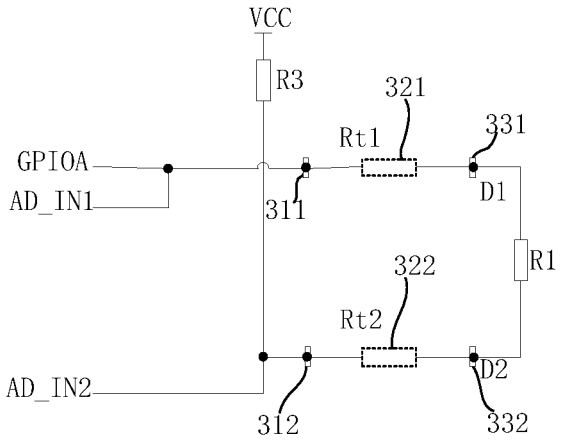
FIG. 10 illustrates a simplified diagram of an exemplary connection circuit between a chip and a body of an image forming apparatus in a second state consistent with an embodiment of the present disclosure.

Because GPIOA is set to high-impedance state input and GPIOB is set to low-impedance state output low level, the circuit in FIG. 8 may be simplified as a loop formed between VCC, R2, Rt1, R1, Rt2 and GPIOB (illustrated in FIG. 9). The voltage value $V_{AD_IN1}$ of AD_IN1 may satisfy Formula 1:

$$V_{AD_IN1} = \frac{Rt_1 + R1 + Rt_2}{R_2 + Rt_1 + R_1 + Rt_2} \times V_{cc}. \quad \text{(Formula 1)}$$

S1201: The contact resistance value of Rt1+Rt2 may be calculated.

The main controller of the image forming apparatus may execute the following. According to Formula 1, the contact resistance value of Rt1+Rt2 obtained in the first round of hardware inspection may be calculated:

$$Rt_1 + Rt_2 = \frac{V_{AD_IN1}(R1 + R2) - VccR_1}{V_{cc} - V_{AD_IN1}}. \quad \text{(Formula 2)}$$

The second round of hardware inspection for detecting the data signal terminal in above step S2 may include following.

S1301: GPIOA may be set to low-impedance state output low level.

S1302: GPIOB may be set to high-impedance state input.

S1303: The VCC power supply may be powered, and the amplitude of the voltage may be recorded as Vcc.

S1304: A voltage value of AD_IN2 may be collected through the ADC in the main controller of the image forming apparatus, and the amplitude of the voltage may be recorded as $V_{AD_IN2}$.

Because GPIOB is set to low-impedance state output low level and GPIOA is set to high-impedance state input, a loop may be formed between VCC, R3, Rt2, R1, Rt1 and GPIOA, and the voltage value $V_{AD_IN12}$ of AD_IN2 may meet Formula 3.

$$V_{AD_IN2} = \frac{Rt_1 + R1 + Rt_2}{R_3 + Rt_1 + R_1 + Rt_2} \times V_{cc}. \quad \text{(Formula 3)}$$

S1401: The contact resistance value of Rt1+Rt2 may be calculated.

The main controller of the image forming apparatus may execute the following. According to Formula 3, the contact resistance value of Rt1+Rt2 obtained in the second round of hardware inspection may be calculated:

$$Rt_1 + Rt_2 = \frac{V_{AD_IN2}(R_3 + R_1) - VccR_1}{V_{cc} - V_{AD_IN2}}. \quad \text{(Formula 4)}$$

Then, based on the values of the contact resistance Rt1+Rt2 calculated twice in S1201 and 1401, the following steps may be performed.

S1501: It may be determined whether the values of Rt1+Rt2 obtained twice are close. In other words, it may be determined whether the resistance value of Rt1+Rt2 calculated in step S1201 is close to the resistance value of Rt1+Rt2 calculated in step S1401. In the present embodiment, preferably, the close allowable error range may be within 10%. In other words, the resistance value of Rt1+Rt2 in Formula 2 may minus the resistance value of Rt1+Rt2 in Formula 4, and then the difference may be divided by the resistance value of Rt1+Rt2 in Formula 2 or the resistance value of Rt1+Rt2 in Formula 4, it may be determined whether the obtained result error is greater than 10%. If yes, step S1601 may be executed, otherwise, step S1502 may be executed.

S1502: It may be determined that the hardware circuit of the SoC or chip is abnormal, and then a hardware abnormal error tray be reported (S1503).

It should be noted that in the technical solutions provided by the present embodiment, after the image forming apparatus is turned on, the SoC may perform a self-test. Therefore, in the chip detection process provided by the present embodiment it is assumed that the SoC hardware is normal, "reported hardware abnormal error" mentioned in all descriptions may often be referred to the chip-side hardware abnormal. Considering that the time difference between the two calculations may not be too long, and after being installed to the image forming apparatus, the replaceable unit may not have a substantially large displacement change in the time interval between the two calculations, and, thus, the resistance value of the contact resistance Rt1+Rt2 may not change in theory. Therefore, it may be speculated that the maximum possibility is that the resistance R1 in the to-be-detected unit is abnormal. Therefore, the "reported hardware abnormal error" mentioned in the present embodiment may often correspond to that the resistance R1 is abnormal. In addition, the 10% mentioned in the above steps may be merely an exemplary description, and those skilled in the art may use different parameters, e.g., 1%, 2%, 5%, 8%, 12%, 15%, 20%, etc., to design according to different accuracy requirements in specific application scenarios.

S1601: It may be determined whether the resistance value of Rt1+Rt2 is within the upper and lower range of the ideal contact resistance value; if yes, step S1701 may be executed, otherwise, step S1602 may be executed.

S1602: It may be determined that the contact between the body-side contact and the chip-side contact is abnormal, and then a contact abnormal error may be reported (S1603).

S1701: It may be determined that the physical connection between the body-side contact and the chip-side contact is normal.

S1702: End.

In the above technical solutions provided by the present embodiment, the stability state of the contact between the electrical contact of the chip and the electrical contact terminal of the body of the image forming apparatus may be accurately determined. Thus, the error caused by improper installation of the replaceable unit, the unreliable contact between the electrical contact of the chip and the electrical contact terminal of the body of the image forming apparatus may be accurately prompted to the user.

Although FIG. 11 performs detection according to the case where the impedance branch is disposed between D1 and D2 in FIG. 8, for the case where the impedance branch is disposed between other contacts among power supply terminal, ground terminal: SCL port, and SDA port, a similar detection method may also be applicable. It should be noted that although the above sampling uses a voltage value, when conditions permit, the sampling may be performed by detecting the current value, or by simultaneously detecting the voltage value and the current value.

Exemplary Embodiment 2

The present embodiment also provides a same image forming apparatus and a same replaceable unit as Embodiment 1. The difference may include that the internal circuit of the chip is different, and the corresponding installation detection method of the chip is different.

Figure 12:
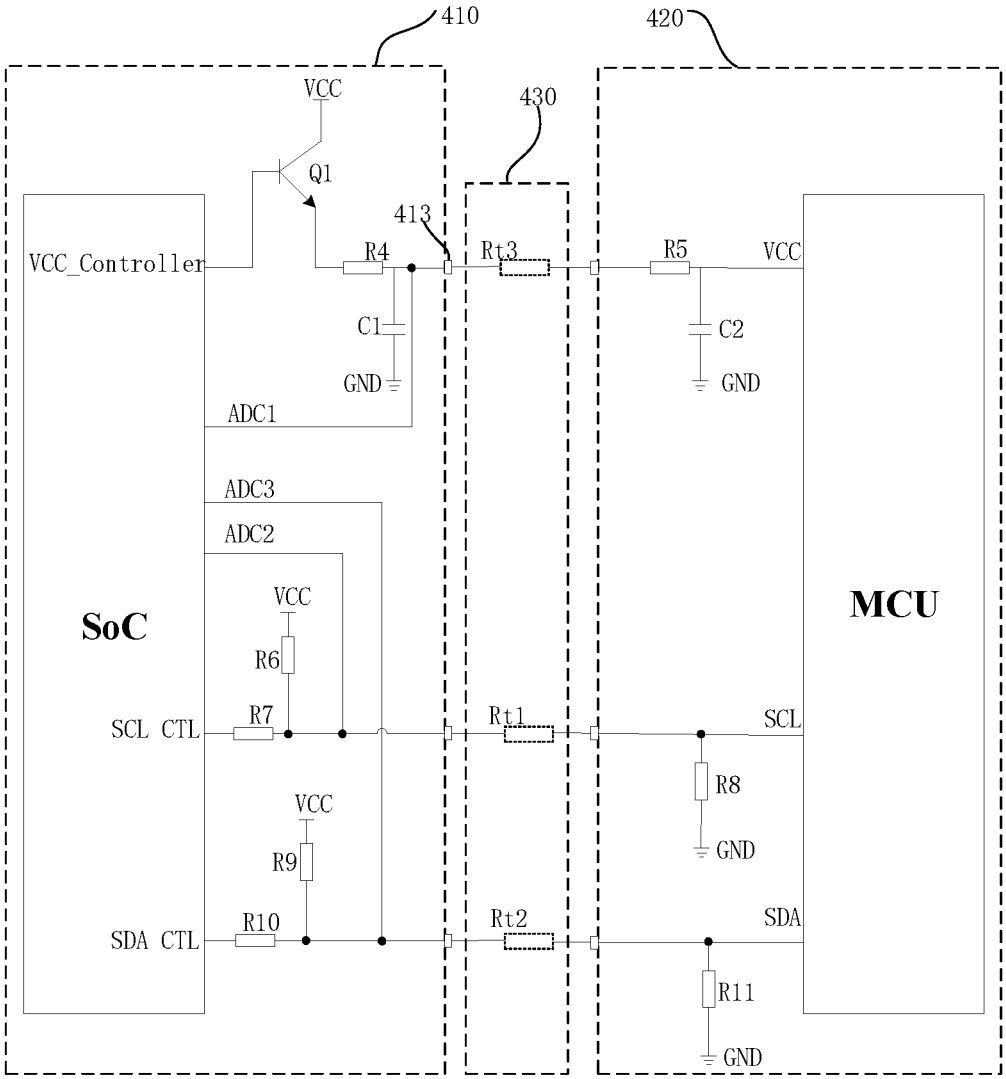
FIG. 12 illustrates a schematic diagram of another exemplary connection circuit between a chip and a body of an image forming apparatus consistent with an embodiment of the present disclosure.

Referring to FIG. 12, the impedance characteristic to-be-detected unit in the chip in the present embodiment may have a specific circuit different from that in Embodiment 1, but it may also be based on the loop formed between the impedance characteristic to-be-detected unit and the reliability state of the contact between the chip-side contact and body-side contact of the image forming apparatus to detect the impedance parameter between the chip-side contact and the body-side contact of the image forming apparatus. Further, reliability detection of the contact between the chip-side contact and the body-side contact of the image forming apparatus may be achieved. Because the impedance characteristic to-be-detected unit in the chip has the specific circuit different from that in Embodiment 1, the detection unit in the image forming apparatus provided by the present embodiment may also change accordingly.

The to-be-detected unit in the chip provided by the present embodiment may also be provided with an impedance branch, but the impedance branch provided by the present embodiment may include a first resistance element and a second resistance element with a predetermined size. One end of the first resistance element may be connected to the clock signal terminal, and another end may be ground. One end of the second resistance element may be connected to the data signal terminal, and another end may be ground. More specifically, referring to FIG. 12, the connection circuit between the chip and the body of the image forming apparatus provided by the present embodiment may include a first control circuit 410 on the image forming apparatus side, a second control circuit 420 on the chip side, and a contact circuit 430 formed between the image forming apparatus-side contact and the chip-side contact. The impedance branch in the present embodiment may include a resistor R8 and a resistor R11. One end of the resistor R8 may be connected to a clock signal contact, and another end may be ground. One end of the resistor R11 may be connected to a data signal contact, and another end may be ground. The detection unit in the image forming apparatus may include a resistor R7 provided between the body-side clock signal terminal and the SoC, a resistor R10 provided between the body-side data signal terminal and the SoC, a first power supply branch circuit (VCC and a resistor R6) as well as a second power supply branch (VCC and a resistor R9) provided on the body-side, a sampling point ADC2 between R7 and Rt1, and a sampling point ADC3 between R10 and Rt2. The ports SCL_CTL and SDA_CTL on the image forming apparatus side in the present embodiment may be used as the clock signal port and the data signal port to be connected to the clock signal pert and the data signal port in the chip during operation, while may be used as the same logic signal control ports as Embodiment 1 in the installation detection process of the chip provided by the present embodiment.

In the above technical solutions provided by the present embodiment, the impedance branch may be provided in the chip as a to-be-detected circuit, which may be used to detect the reliability state of the contact between electrical contact of the chip and the electrical contact terminal of the body of the image forming apparatus. When the replaceable unit is installed to the image forming apparatus, if the reliability of the contact between the chip-side electrical contact and the body-side electrical contact terminal of the image forming apparatus does not meet the requirements due to improper installation of the replaceable unit, such state may be detected in time.

The chip detection method corresponding to FIG. 12 may also include following.

S1: Obtaining a first voltage and/or current parameter of the clock signal terminal in the body of the image forming apparatus.

S2: Obtaining a second voltage and/or current parameter of the data signal terminal in the body of the image forming apparatus.

S3: Based on the impedance parameter of the impedance branch and the power supply voltage of the to-be-detected unit disposed between the second clock signal terminal and the second data signal terminal in the chip, the first voltage and/or current parameter, and the second voltage and/or current parameter, outputting a first impedance parameter between the first clock signal terminal and the second clock signal terminal and a second impedance parameter between the first data signal terminal and the second data signal terminal.

S4: Based on values of the first impedance parameter and the second impedance parameter, outputting the reliability state information of the contact between the second clock signal terminal and the second data signal terminal in the chip and the first clock signal terminal and the first data signal terminal in the body of the image forming apparatus, respectively.

Figure 15:
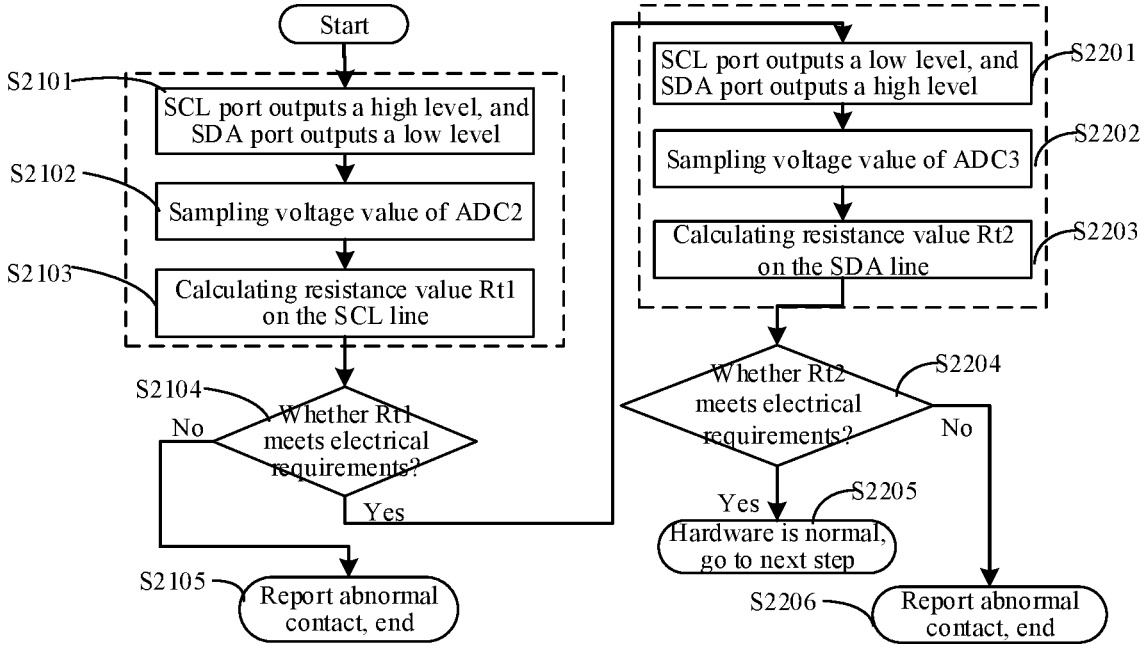
FIG. 15 illustrates a flowchart of another exemplary installation detection method of a chip consistent with an embodiment of the present disclosure.

Referring to FIG. 15, the detect on method provided by the present embodiment may specifically include following.

The first round of hardware inspection for detecting the clock signal terminal in the above step S1 may include following.

Figure 13:
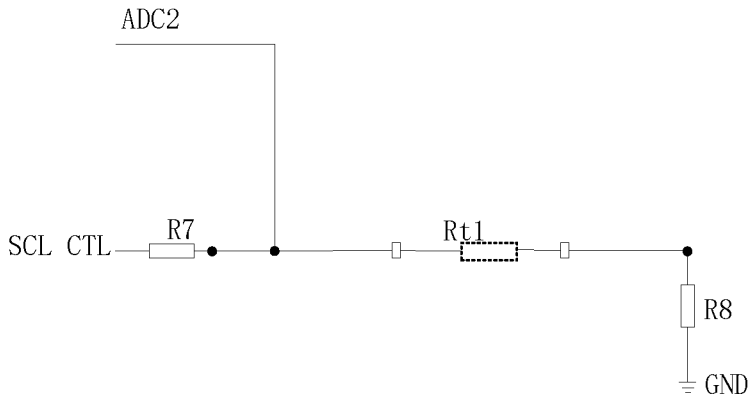
FIG. 13 illustrates a simplified diagram of another exemplary connection circuit between a chip and a body of an image forming apparatus in a first state consistent with an embodiment of the present disclosure.

S2101: The SCL port may output a high level, and the SDA port may output a low-level, and, thus, SCL_CTL, R7, Rt1, R8, and GND may form a loop (as illustrated in FIG. 13).

S2102: The voltage value of ADC2 may be sampled.

S2103: The resistance value Rt1 of Rt1 on the SCL line may be calculated:

$$R_{t1} = \frac{V_{ADC3} \times R_7 - (V_{SCL_H} - V_{ADC3}) \times R_8}{V_{SCL_H} - V_{ADC3}}. \quad \text{(Formula 5)}$$

The second round of hardware inspection for detecting the data signal terminal in above step S2 may include following.

Figure 14:
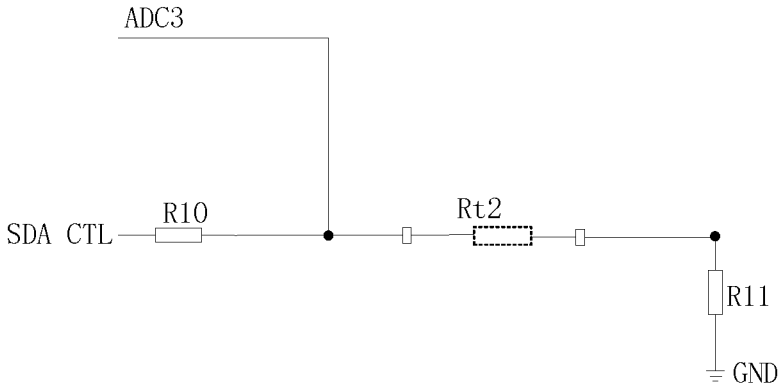
FIG. 14 illustrates a simplified diagram of another exemplary connection circuit between a chip and a body of an image forming apparatus in a second state consistent with an embodiment of the present disclosure.

S2201: The SCL port may output a low level, the SDA port may output a high level, and, thus, SDA_CTL, R10, Rt2, R11, GND may form a loop (as illustrated in FIG. 14).

S2202: The voltage value of ADC3 may be sampled.

S2203: The resistance value Rt2 of Rf2 on the SDA line may be calculated;

$$R_{t2} = \frac{V_{ADC3} \times R_{10} - (V_{SDA_H} - V_{ADC3}) \times R_{11}}{V_{SDA_H} - V_{ADC3}}. \quad \text{(Formula 6)}$$

The difference between the present embodiment and Embodiment 1 may include that each round of hardware inspection in the present embodiment may independently achieve the detection of the impedance value between corresponding contacts once, such that the reliability of the contact between corresponding contacts may be directly determined. In other words, portion of the determination information in step S3 may be achieved before performing the step S2.

After performing the step S2103, the step S2104: it may be determined whether Rt1 meets the predetermined requirements, in other words, whether the resistance value of Rt1 in the calculation result of Formula 5 is within a specified range, may be directly performed. If yes, the step S2201 may be executed, otherwise, the step S2105 may be executed.

S2105: Abnormal contact may be reported, and end.

After performing the step S2203, the step S2204; it may be determined whether Rt2 meets the predetermined requirements, in other words, whether the resistance value of Rt2 in the calculation result of Formula 6 is within a specified range, may be directly performed. If yes, the step S2205 may be executed, otherwise, the step S2206 may be executed.

S2205: It may be determined that the hardware is normal, and the next step, e.g., further detecting whether the parameter in the MCU in the chip meets the requirements, may be performed.

S2206: Abnormal contact may be reported, and end.

Preferably, after performing the step S2204, a step of determining whether the contact resistance values of Rt1 and Rt2 are close, e.g., whether the error between the two is within 10%, may be added. If yes, the step S2205 may be executed, otherwise, the step S2206 may be executed. Because the difference in physical characteristics of various chip-side contacts may be substantially small, and various contacts on the image forming apparatus side may be basically the same, in theory, the contact resistance values of Rt1 and Rf2 may be the same. Within the allowable manufacturing error range (e.g., 10%), if the values of Rt1 and Rt2 are different, it may mean that the error may not meet the requirements during hardware manufacturing or the location of the contact of the replaceable unit is incorrect during the installation process. Therefore, after adding such preferred determination step, the detection result of whether the reliability of the contact of the chip contacts is desirably functional may be further improved.

In the above technical solutions provided by the present embodiment, the stability state of the contact between the electrical contact of the chip and the electrical contact terminal of the body of the image forming apparatus may be accurately determined. Thus, the error caused by improper installation of the replaceable unit, or the unreliable contact between the electrical contact of the chip and the electrical contact terminal of the body of the image forming apparatus may be accurately prompted to the user.

In addition, in the above technical solutions provided by the present embodiment, before the SoC communicates with the chip, the hardware condition may be first detected, and if the hardware condition is desirably functional, then normal communication may be performed to ensure data security and completeness during the communication process.

Exemplary Embodiment 3

The present embodiment may be further optimized on the basis of the Embodiment 2. The detection on power-up and power-down timing sequences may be first performed on the chip, and then the contact impedance detection may be performed on the communication line. When the power-up and power-down timing sequences are normal and the contact impedance of the communication line is normal, the communication may be performed, which may effectively prevent abnormal hardware front causing wrong data communication.

Specifically, in addition to the description associated with FIG. 12 in Embodiment 2, the hardware circuit provided by the present embodiment may further include a chip-side power supply line VCC, a resistor R5 disposed between the power supply terminal and the MCU, a capacitor C2 having one end connected to R5 and another end connected to ground, a body-side power supply terminal VCC, Q1 connected to VCC, a resistor R4, and a capacitor C1. Q1 may also be connected to the power supply VCC_controller and one end of R4, respectively. Another end of R4 may be connected to the body-side power supply terminal. The capacitor C1 may be located between the another end of R4 and the ground. An ADC sampling may be performed on die another end of R4 to obtain the voltage value of ADC1.

Figure 16:
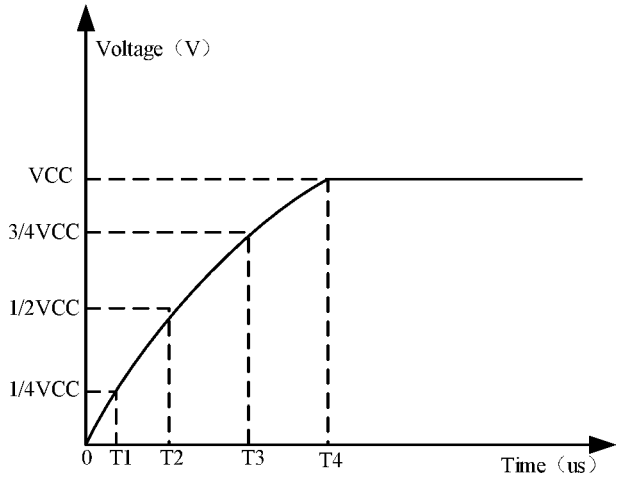
FIG. 16 illustrates an exemplary power-up timing sequence diagram of a power supply in a chip consistent with an embodiment of the present disclosure.
Figure 18:
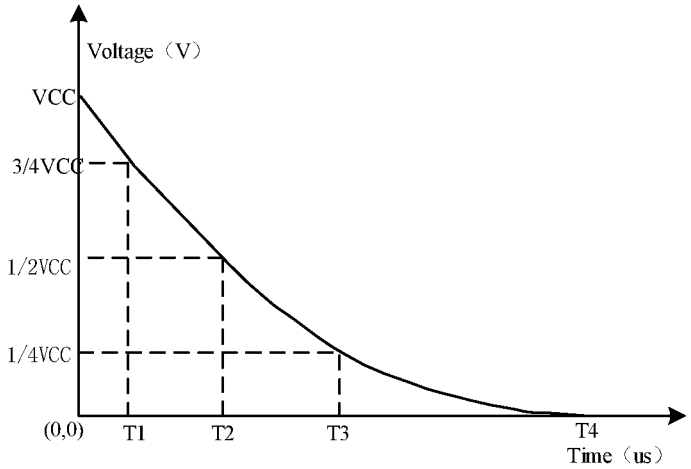
FIG. 18 illustrates an exemplary power-down timing sequence diagram of a power supply in a chip consistent with an embodiment of the present disclosure.

In the above circuit provided by the present embodiment, the ideal ADC1 power-up sampling curve obtained through testing or calculation may be illustrated in FIG. 16, and the ideal ADC1 power-down sampling curve may be illustrated in FIG. 18. Therefore, the present embodiment may detect whether there is an abnormality in the connection between the body-side and chip-side power supplies through comparison.

Figure 17:
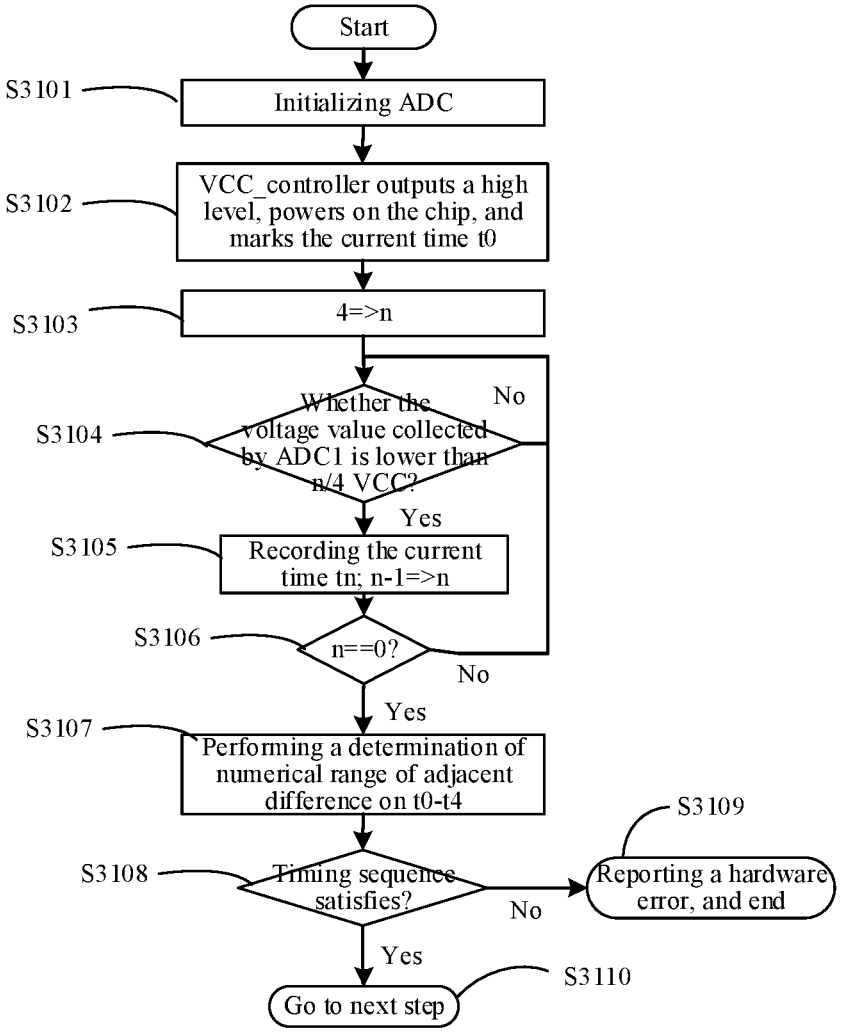
FIG. 17 illustrates a flowchart of an exemplary method for detecting chip status during a power-up process of the chip consistent with an embodiment of the present disclosure.

Referring to FIG. 17, the power-up detection method may include following.

S3101: The ADC may be initialized.

S3102: The VCC_controller may output a high level, power on the chip, and mark the current time t0.

S3103: A value of 4 may be assigned to n, i.e., 4=>n.

S3104: It may be determined whether the voltage value collected by ADC1 is lower than n/4 VCC; if yes, step S3105 may be executed, otherwise, the step S3104 may be returned to continue the determination.

S3105: The current time tn may be recorded, and a value equal to n−1 may be assigned to n, i.e., n−1=>n.

S3106: It may be determined whether "n==0" is true; if yes, step S3107 may be executed, otherwise, step S3104 may be returnee.

S3107: A determination of numerical range of adjacent difference may be performed on t0-t4; and then step S3108 may be executed.

S3108: It may be determined whether the timing sequence sorted in step S3107 meets the power-up timing sequence in FIG. 16; if it is not satisfied, step S3109 may be executed, otherwise, step S3110 may be executed.

S3109: A hardware error may be reported, and end.

S3110: The next step, e.g., detecting the contact reliability of the contacts mentioned above, may be performed.

Figure 19:
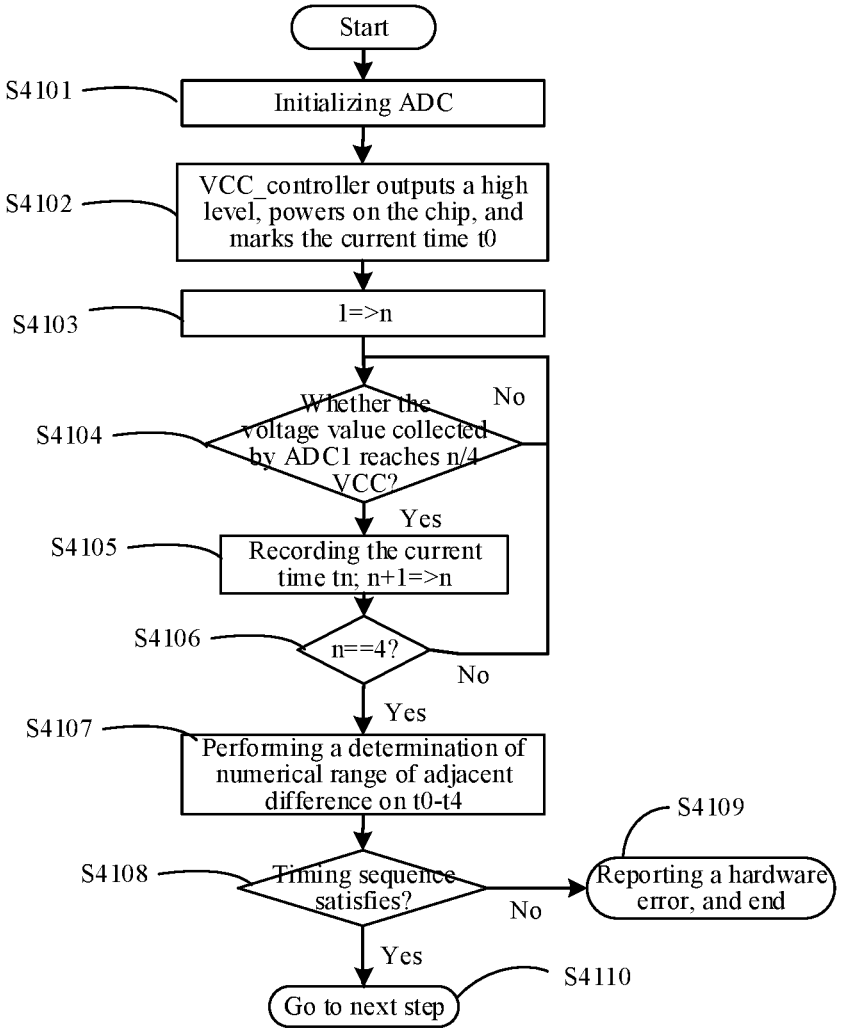
FIG. 19 illustrates a flow chart of an exemplary method for detecting chip status during a power-down process of the chip consistent with an embodiment of the present disclosure.

Referring to FIG. 19, the power-down detection method may include following.

S4101: The ADC may be initialized.

S4102: The VCC_controller may output a high level, power on the chip, and mark the current time t0.

S4103: A value of 1 may be assigned to n, i.e., 1=>n.

S4104: It may be determined whether the voltage value collected by ADC1 reaches n/4 VCC; if yes, step S4105 may be executed, otherwise, the current step may be returned to continue the sampling and determination.

S4105: The current time tn may be recorded, and a value equal to n+1 may be assigned to n, i.e., n+1=>n.

S4106: It may be determined whether "n==4" is true, i.e., n==4?; if yes, step S4107 may be executed, otherwise, step S4104 may be returned.

S4107: A determination of numerical range of adjacent difference may be performed on t0-t4, and then step S4108 may be executed.

S4108: It may be determined whether the timing sequence sorted in step S4107 meets the power-down timing sequence in FIG. 18; if it is not satisfied, step S4119 may be executed, otherwise, step S4110 may be executed.

S4109: A hardware error may be reported, and end.

S4110: The next step, e.g., detecting the contact reliability of the contacts mentioned above, may be performed. The technical solutions provided by the present embodiment may ensure that the chip is connected to the power supply and the power supply inside the chip responds normally by detecting the power-up and power-down performance of the power supply of the chip. By detecting the contact resistance between the body-side contact and the chip-side contact, communication may be performed based on a desired hardware foundation.

Exemplary Embodiment 4

Similarly, the present embodiment also provides a same image forming apparatus and a same replaceable unit. The difference may include that the internal circuit of the chip is different, and the corresponding installation detection method of the chip is also different. With respect to the circuit provided in Embodiment 1 or Embodiment 2, the impedance characteristic to-be-detected unit mentioned in the present embodiment may also include a plurality of contact resistors. For the convenience of expression and calculation, the contact resistance value of each contact resistor may be a sum including the resistance of the chip-side contact (not illustrated) itself corresponding to the contact resistor, and the resistance of the body-side contact (not illustrated) itself of the image forming apparatus corresponding to the contact resistor, respectively. The symbols of resistors and capacitors in the circuit used in the present embodiment may be slightly different from those in the previous embodiment, but for those skilled in the art, the meanings corresponding to these components may be clear, and the meanings of different symbolic representations may be somewhat same, which may not be repeated herein.

The impedance characteristic to-be-detected unit in the chip in the present embodiment may have a specific circuit different from that in Embodiment 1 or Embodiment 2, but it may also be based on the loop formed between the impedance characteristic to-be-detected unit and the reliability state of the contact between the chip-side contact and body-side contact of the image forming apparatus to detect the impedance parameter (or resistance parameter in the present embodiment) between the chip-side contact and the body-side contact of the image forming apparatus. Further, reliability detection of the contact between the chip-side contact and the body-side contact of the image forming apparatus may be achieved. Because the impedance characteristic to-be-detected unit in the chip has the specific circuit different from that in the Embodiment 1 or Embodiment 2, the detection unit in the image forming apparatus provided by the present embodiment may also change accordingly.

Figure 20:
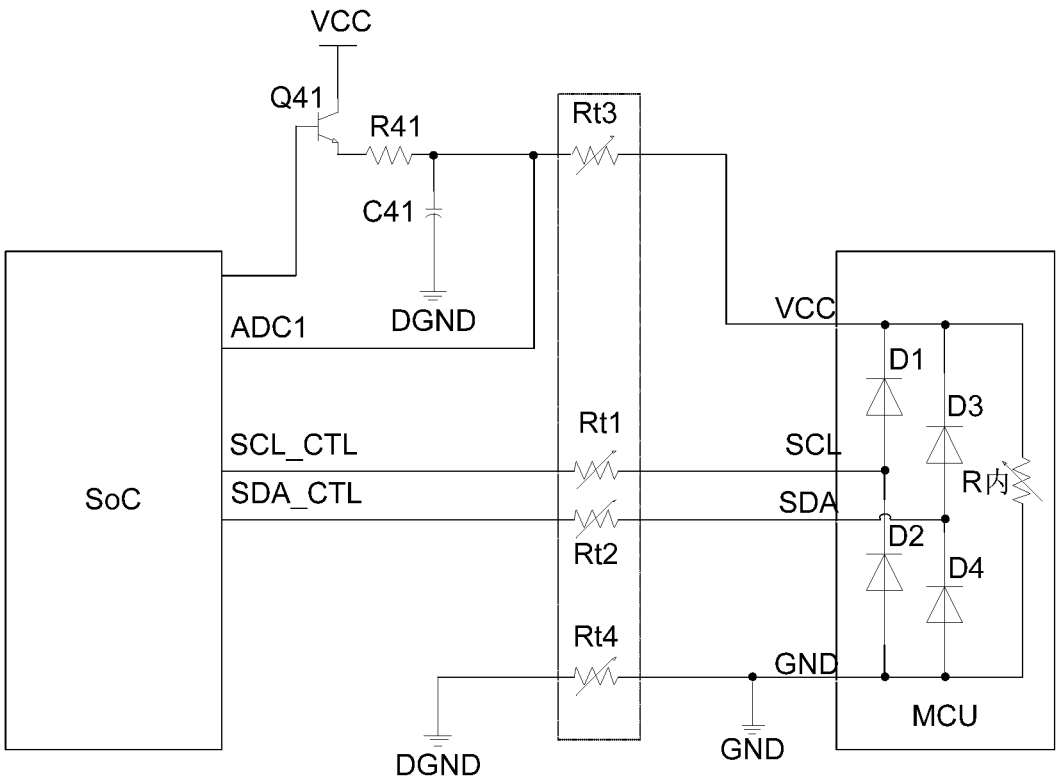
FIG. 20 illustrates a schematic diagram of another exemplary connection circuit between a chip and a body of an image forming apparatus consistent with an embodiment of the present disclosure.

Referring to FIG. 20, the ports SCL_CTL and SDA_CTL on the image forming apparatus side in the present embodiment may be used as the clock signal port and the data signal port to be connected to the clock signal pen and the data signal port in the chip during operation, while may be used as the same logic signal control ports as Embodiment 1 or Embodiment 2 in the installation detection process of the chip provided by the present embodiment. The branch corresponding to the VCC side on the image forming apparatus side may include a control terminal connected to the SoC. The control terminal may be connected to the power supply VCC through a transistor Q41, and another terminal of the transistor Q41 may be directly connected to a fixed resistor R41. Another end of the fixed resistor R41 may be connected to a capacitor C41, and another end of the capacitor C41 may be connected to a power supply terminal that supplies power to the chip. An ADC1 signal sampling terminal may also be provided between the SoC and the power supply terminal. The chip side (the circuit corresponding to the right side of the dashed frame in FIG. 20) may be provided with contact terminals respectively corresponding to the detection circuit on the image forming apparatus side (the circuit corresponding to the left side of the dashed frame in FIG. 20). It should be noted that VCC, SCL, SDA, and GND corresponding to the chip side in FIG. 20 may respectively represent branches or contacts corresponding to the detection circuit on the image forming apparatus side. In addition, the chip provided by the present embodiment may be provided with a plurality of unidirectional diodes D1, D2, D3, D4 and an internal resistance $R_{internal}$ connected in parallel with the diodes.

The working process of the detection circuit corresponding to FIG. 20 provided by the present embodiment may include following.

Figure 21:
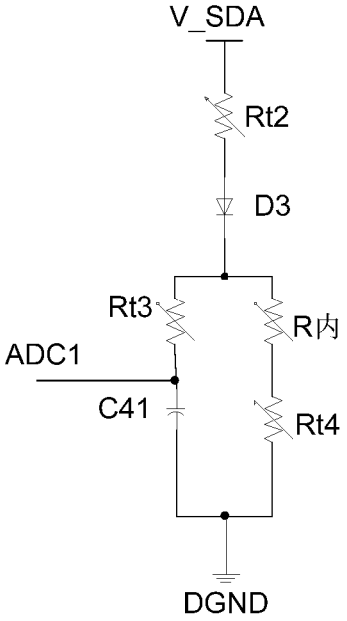
FIG. 21 illustrates a simplified diagram of another exemplary connection circuit between a chip and a body of an image forming apparatus in a first state consistent with an embodiment of the present disclosure.

1. The SDA_CTL on the image forming apparatus side may be powered at a high level, while the SCL_CTL on the image forming apparatus side may be open, and the VCC on the image forming apparatus side may not provide voltage; merely the diode D3 may be turned on, and the correspondingly formed simplified circuit diagram may be illustrated in FIG. 21, and, thus, merely Rt2, Rt3 and Rt4 may be unknown variables in the entire circuit.

Figure 22:
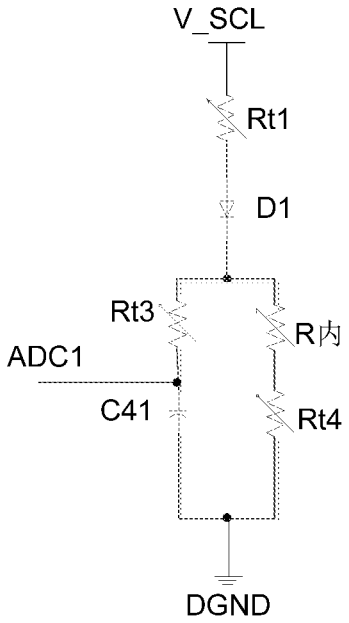
FIG. 22 illustrates a simplified diagram of another exemplary connection circuit between a chip and a body of an image forming apparatus in a second state consistent with an embodiment of the present disclosure.

2. The SCL_CTL on the image forming apparatus side may be powered at a high level, while the SDA_CTL on the image forming apparatus side may be open, and the VCC on the image forming apparatus side may not provide voltage; merely the diode D1 may be turned on, and the correspondingly formed simplified circuit diagram may be illustrated in FIG. 22, and, thus, merely Rt1, Rt3 and Rt4 may be unknown variables in the entire circuit.

Figure 23:
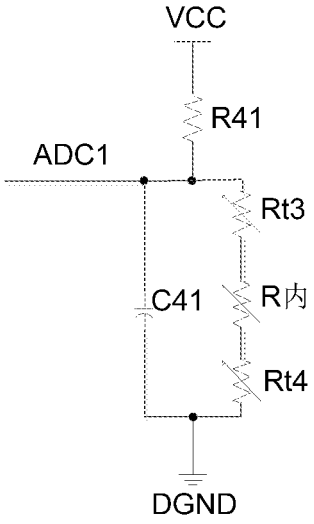
FIG. 23 illustrates a simplified diagram of an exemplary connection circuit between a chip and a body of an image forming apparatus in a third state consistent with an embodiment of the present disclosure.

3. The VCC on the image forming apparatus side may provide voltage, and the SCL_CTL and SDA_CTL on the image forming apparatus side may be open; all the diodes may be turned off, and the correspondingly formed simplified circuit diagram may be illustrated in FIG. 23, and, thus, merely Rt3 and Rt4 may be unknown variables in the entire circuit.

In the detection process provided by the present embodiment, the resistance value of each contact resistor may not be directly compared and calculated, while the power-up or power-down curves of the capacitor C41 may be collected during the charging and discharging processes of the capacitor C41 through the above three cases, respectively. The specific process may refer to the detection method in Embodiment 3, by comparing whether the charging and discharging of the capacitor C41 meet the predetermined requirements, whether the parameter ranges of Rt1, Rt2, Rt3, and Rt4 meet the predetermined requirements may be estimated. Further, whether the contact between the image forming apparatus and the chip in the replaceable unit meets the predetermined requirements may be estimated.

Exemplary Embodiment 5

Figure 24:
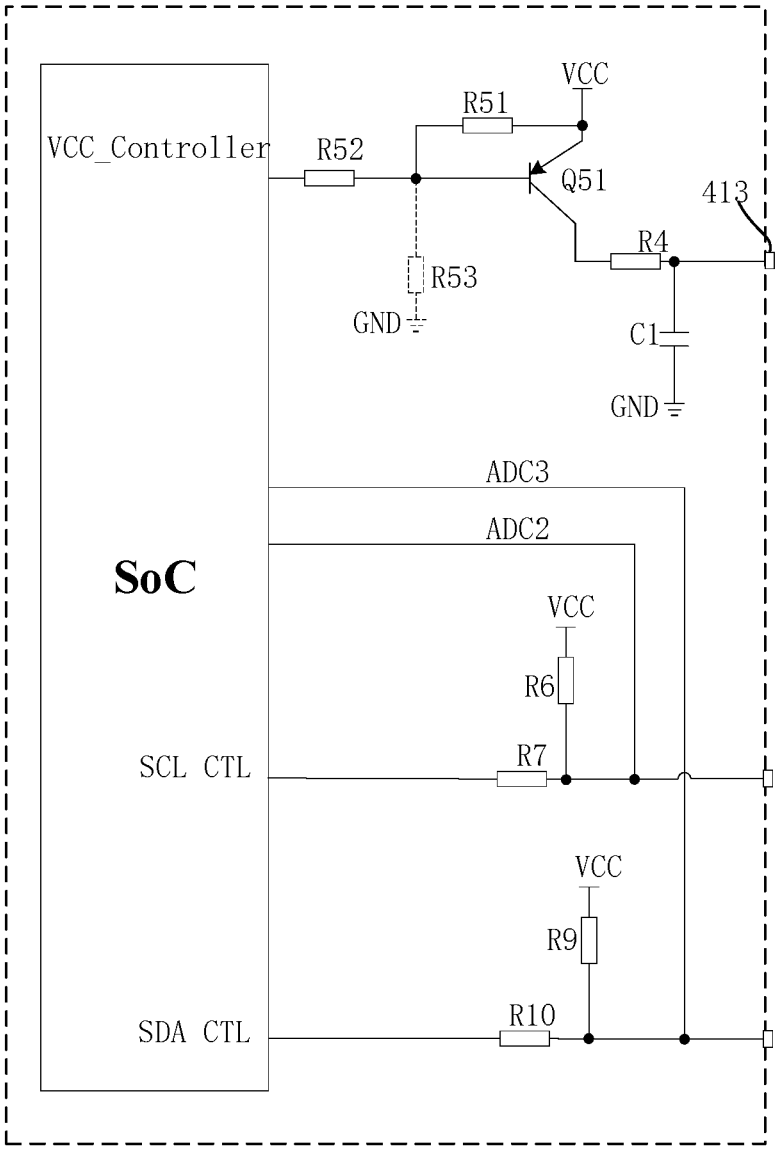
FIG. 24 illustrates a simplified schematic diagram of an exemplary circuit of a body of an image forming apparatus consistent with an embodiment of the present disclosure.

Referring to FIG. 24, in the present embodiment, the VCC circuit connected to the VCC Controller in the body-side circuit of the image forming apparatus mentioned in FIG. 12 may be improved. In the present embodiment, the transistor Q1 with NPN type in FIG. 12 may be replaced with a transistor Q51 with PNP type. A pull-up resistor may be added between the e electrode and the b electrode of the transistor Q51, and a current limiting resistor R52 may be added between the voltage output terminal of the VCC Controller and the b electrode of the transistor Q51. With respect to the implementation manner in FIG. 12, in the case where the adjustable range of the voltage at the output terminal of the VCC Controller is limited, the voltage amplitude of the voltage output terminal 413 in the body-side circuit of the image forming apparatus may be adjusted with R52. More specifically, a turn-on voltage between the b electrode and e electrode of the transistor Q1 with NPN type may be approximately 0.7V. and a turn-on voltage between the b electrode and e electrode of the transistor Q51 with PNP type may be approximately 0.7V. For illustrative purposes, 0.7V may be used as an example for description. The corresponding Vb and Ve in FIG. 12 may satisfy a relationship; $Vb \geq Ve+0.7$, while Vb and Ve in the present embodiment may satisfy a relationship: $Vb \leq Ve+0.7$. Because available voltages supplied by the existing VCC Controller in the body-side circuit of the image forming apparatus are often 3.3V or 5.0V, while the amplitude range of the voltage output terminal 413 may be often 3.3V, such that the technical solutions provided by the present embodiment may better meet such requirements.

In addition, the VCC circuit connected to the VCC Controller provided by the present embodiment may also be applicable to the circuit solution provided in FIG. 8.

In the technical solutions provided by the above-disclosed embodiments of the present disclosure, the electrical characteristic parameter corresponding to the reliability of the contact between the chip in the replaceable unit and the image forming apparatus may be detected through communication with the serial bus (including IIC, USART, etc.). Therefore, the physical characteristics of the connection between the image forming apparatus and the chip in the replaceable unit may be accurately obtained, and the reason why the consumable is not recognized, which is caused by contact or by the chip itself, may be accurately prompted to the user.

What is claimed is:

1. A chip, used for a replaceable unit of an image forming apparatus, wherein the image forming apparatus is provided with an electrical contact terminal, the chip comprising:

a storage unit, configured to store related parameters of the replaceable unit;

a plurality of electrical contacts, wherein an electrical contact of the plurality of electrical contacts is capable of electrically connecting to the electrical contact terminal; and an impedance branch, wherein one end of the impedance branch is connected to at least one of the plurality of electrical contacts for achieving a detection of contact reliability between the at least one of the plurality of electrical contacts connected to the impedance branch and the electrical contact terminal of the image forming apparatus.

2. The chip according to claim 1, wherein another end of the impedance branch is connected to another electrical contact, such that after the chip is installed to the image forming apparatus, a loop for detecting a reliability of electrical connection is formed.

3. The chip according to claim 2, wherein one end of the impedance branch is connected to a clock signal terminal of the image forming apparatus, and another end of the impedance branch is connected to a data signal terminal of the image forming apparatus.

4. The chip according to claim 3, wherein the impedance branch includes a resistance element having a predetermined impedance value, wherein the resistance element has an end connected to the clock signal terminal, and another end connected to the data signal terminal.

5. The chip according to claim 2, wherein the loop for detecting the reliability of the electrical connection is a loop formed between the image forming apparatus and the chip after the replaceable unit is installed to the image forming apparatus; by sampling voltage and/or current of the loop, electrical characteristics formed by contact between the at least one of the plurality of electrical contacts in the chip and a corresponding electrical contact terminal of the image forming apparatus in the loop is obtained, and based on the electrical characteristics formed by the contact, the reliability of electrical connection between the at least one of the plurality of electrical contacts in the chip and the corresponding electrical contact terminal of the image forming apparatus is determined.

6. The chip according to claim 1, wherein another end of the impedance branch is ground, such that after the chip is installed to the image forming apparatus, a loop for detecting a reliability of electrical connection is formed.

7. A replaceable unit for an image forming apparatus, comprising:

a developing cartridge, wherein the developing cartridge is provided with a case, a developer accommodation unit for accommodating developer in the case, a developer-feed element that feeds the developer, and a chip located on an outer surface of the case, the chip comprising:

a storage unit, storing performance parameters of the replaceable unit, and a plurality of electrical contacts, wherein an electrical contact is capable of electrically connecting to an electrical contact terminal of the image forming apparatus, wherein the chip further includes:

an impedance branch, wherein one end of the impedance branch is connected to at least one of the plurality of electrical contacts for achieving a detection of contact reliability between the at least one of the plurality of electrical contacts connected to the impedance branch and the electrical contact terminal of the image forming apparatus.

8. The replaceable unit according to claim 7, wherein another end of the impedance branch is connected to another electrical contact, such that after the chip is installed to the image forming apparatus, a loop for detecting a reliability of electrical connection is formed.

9. The replaceable unit according to claim 8, wherein one end of the impedance branch is connected to a clock signal terminal of the image forming apparatus, and another end of the impedance branch is connected to a data signal terminal of the image forming apparatus.

10. The replaceable unit according to claim 9, wherein the impedance branch includes a resistance element having a predetermined impedance value, wherein the resistance element has an end connected to the clock signal terminal, and another end connected to the data signal terminal.

11. The replaceable unit according to claim 8, wherein the loop for detecting the reliability of the electrical connection is a loop formed between the image forming apparatus and the chip after the replaceable unit is installed to the image forming apparatus; by sampling voltage and/or current of the loop, electrical characteristics formed by contact between the at least one of the plurality of electrical contacts in the chip and a corresponding electrical contact terminal of the image forming apparatus in the loop is obtained; and based on the electrical characteristics formed by the contact, the reliability of electrical connection between the at least one of the plurality of electrical contacts in the chip and the corresponding electrical contact terminal of the image forming apparatus is determined.

12. The replaceable unit according to claim 7, wherein another end of the impedance branch is ground, such that after the chip is installed to the image forming apparatus, a loop for detecting a reliability of electrical connection is formed.

13. A replaceable unit for an image forming apparatus, comprising:

a drum unit, wherein the drum unit is provided with a developing cartridge accommodation part for accommodating a developing cartridge, a photosensitive drum, a charging roller for charging the photosensitive drum, and a chip located on an outer surface of a case of the drum unit, the chip comprising:

a storage unit, storing performance parameters of the replaceable unit, and a plurality of electrical contacts, wherein an electrical contact is capable of electrically connecting to an electrical contact terminal of the image forming apparatus, wherein the chip further includes:

an impedance branch, wherein one end of the impedance branch is connected to at least one of the plurality of electrical contacts for achieving a detection of contact reliability between the at least one of the plurality of electrical contacts connected to the impedance branch and the electrical contact terminal of the image forming apparatus.

14. The replaceable unit according to claim 13, wherein another end of the impedance branch is connected to another electrical contact, such that after the chip is installed to the image forming apparatus, a loop for detecting a reliability of electrical connection is formed.

15. The replaceable unit according to claim 14, wherein one end of the impedance branch is connected to a clock signal terminal of the image forming apparatus, and another end of the impedance branch is connected to a data signal terminal of the image forming apparatus.

16. The replaceable unit according to claim 15, wherein the impedance branch includes a resistance element having a predetermined impedance value, wherein the resistance element has an end connected to the clock signal terminal, and another end connected to the data signal terminal.

17. The replaceable unit according to claim 14, wherein the loop for detecting the reliability of the electrical connection is a loop formed between the image forming apparatus and the chip after the replaceable unit is installed to the image forming apparatus; by sampling voltage and/or current of the loop, electrical characteristics formed by contact between the at least one of the plurality of electrical contacts in the chip and a corresponding electrical contact terminal of the image forming apparatus in the loop is obtained; and based on the electrical characteristics formed by the contact, the reliability of electrical connection between the at least one of the plurality of electrical contacts in the chip and the corresponding electrical contact terminal of the image forming apparatus is determined.

18. The replaceable unit according to claim 13, wherein another end of the impedance branch is ground, such that after the chip is installed to the image forming apparatus, a loop for detecting a reliability of electrical connection is formed.

* * * * *